US008607458B2

(12) United States Patent
Hosseini et al.

(10) Patent No.: US 8,607,458 B2
(45) Date of Patent: Dec. 17, 2013

(54) TUBE TOOL DEVICE

(75) Inventors: Bijan Hosseini, Newport Beach, CA (US); Scott Haynes Stevenson, Aliso Viejo, CA (US)

(73) Assignee: Handsfree Marketing, Inc., Huntington Beach, CA (US)

( * ) Notice: Subject to any disclaimer, the term of this patent is extended or adjusted under 35 U.S.C. 154(b) by 847 days.

(21) Appl. No.: 12/417,563

(22) Filed: Apr. 2, 2009

(65) Prior Publication Data

US 2009/0249628 A1 Oct. 8, 2009

Related U.S. Application Data

(63) Continuation of application No. 11/412,054, filed on Apr. 26, 2006, now Pat. No. 8,028,417.

(60) Provisional application No. 61/042,355, filed on Apr. 4, 2008.

(51) Int. Cl.
*B65D 35/36* (2006.01)
*B65D 35/24* (2006.01)

(52) U.S. Cl.
USPC ..... 30/41; 30/92; 30/526; 222/191; 222/575

(58) Field of Classification Search
USPC ..... 30/41, 92, 41.5, 535, 538, 123, 526; 222/191, 575; 401/129, 130; 15/244, 15/244.4, 119.4, 228, 244.1, 116.1, 116.2
See application file for complete search history.

(56) References Cited

U.S. PATENT DOCUMENTS

| | | | | | |
|---|---|---|---|---|---|
| 1,433,167 | A | * | 10/1922 | Worden | 222/105 |
| 1,581,563 | A | | 4/1926 | Brown | |
| 1,673,590 | A | * | 6/1928 | Redheffer | 30/41 |
| 1,878,475 | A | | 9/1932 | Driest | |
| 1,899,841 | A | * | 2/1933 | Acken | 30/41 |
| 1,949,976 | A | | 3/1934 | Runnels | |
| 1,977,529 | A | | 10/1934 | Hassel | |
| 3,135,007 | A | | 6/1964 | Howell | |
| 3,226,762 | A | | 1/1966 | Norman | |
| 3,356,441 | A | | 12/1967 | Schwartzman | |
| 3,756,732 | A | | 9/1973 | Stoffler | |
| 4,027,985 | A | | 6/1977 | Loesser | |
| 4,446,965 | A | | 5/1984 | Montiel | |
| D281,282 | S | * | 11/1985 | Lazarus | D28/47 |
| 4,817,229 | A | | 4/1989 | Sedillo | |
| 4,964,372 | A | | 10/1990 | Zeeni et al. | |
| 4,977,669 | A | * | 12/1990 | Clifford | 30/41 |
| 5,054,503 | A | | 10/1991 | Keller | |
| 5,269,062 | A | | 12/1993 | Dallaire | |
| 5,638,990 | A | | 6/1997 | Kastberg | |
| 5,649,859 | A | | 7/1997 | Shiga | |

(Continued)

FOREIGN PATENT DOCUMENTS

JP 2003166511 A * 6/2003

*Primary Examiner* — Ghassem Alie
(74) *Attorney, Agent, or Firm* — Novel IP

(57) ABSTRACT

The present invention is directed to an implement holder and a flexible tube handle that has semi-rigid or flexible walls. The tube handle has a frame adapted to be removably secured to the sealed end of the flexible tube. The frame has an attachment portion and a tool portion. The attachment portion has a first surface adapted to generally encircle and/or grip a portion of the sealed end or body of the flexible tube and the tool portion has a tube holder adapted to receive a tool or having a tool affixed thereto.

10 Claims, 20 Drawing Sheets

(56) References Cited

U.S. PATENT DOCUMENTS

| | | | | | |
|---|---|---|---|---|---|
| 5,701,674 | A * | 12/1997 | Mitchell | ..... | 30/41 |
| 5,871,020 | A | 2/1999 | DeVone | | |
| 6,053,184 | A | 4/2000 | DeVone | | |
| D426,917 | S | 6/2000 | Hokanson | | |
| 6,754,958 | B2 | 6/2004 | Haws et al. | | |
| 6,789,321 | B2 | 9/2004 | Simms | | |
| 7,611,013 | B2 * | 11/2009 | Leventhal et al. | ..... | 206/463 |

* cited by examiner

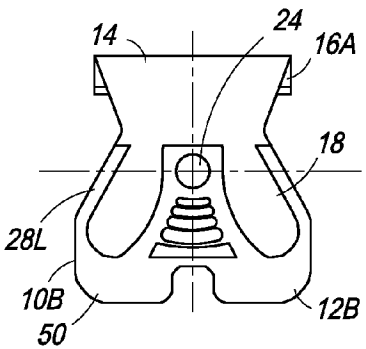
FIG. 17
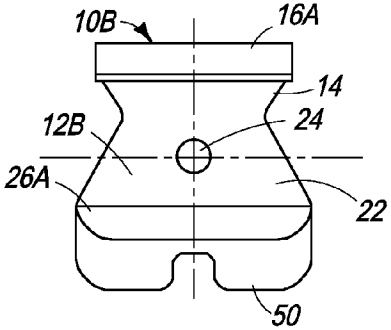
FIG. 18
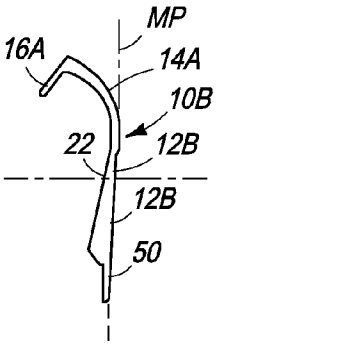
FIG. 19
FIG. 20
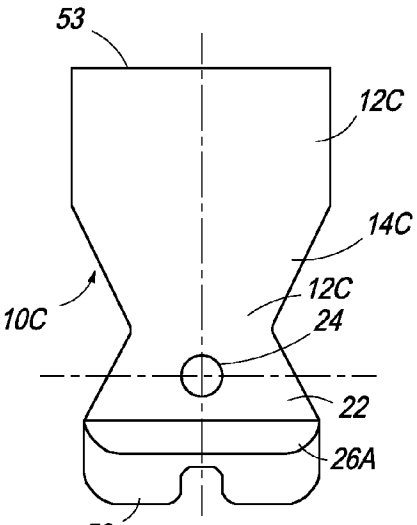
FIG. 21
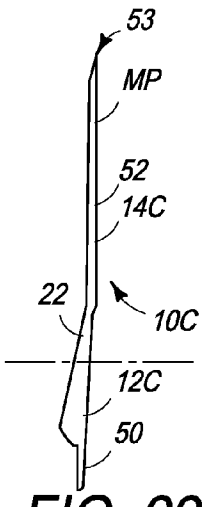
FIG. 22

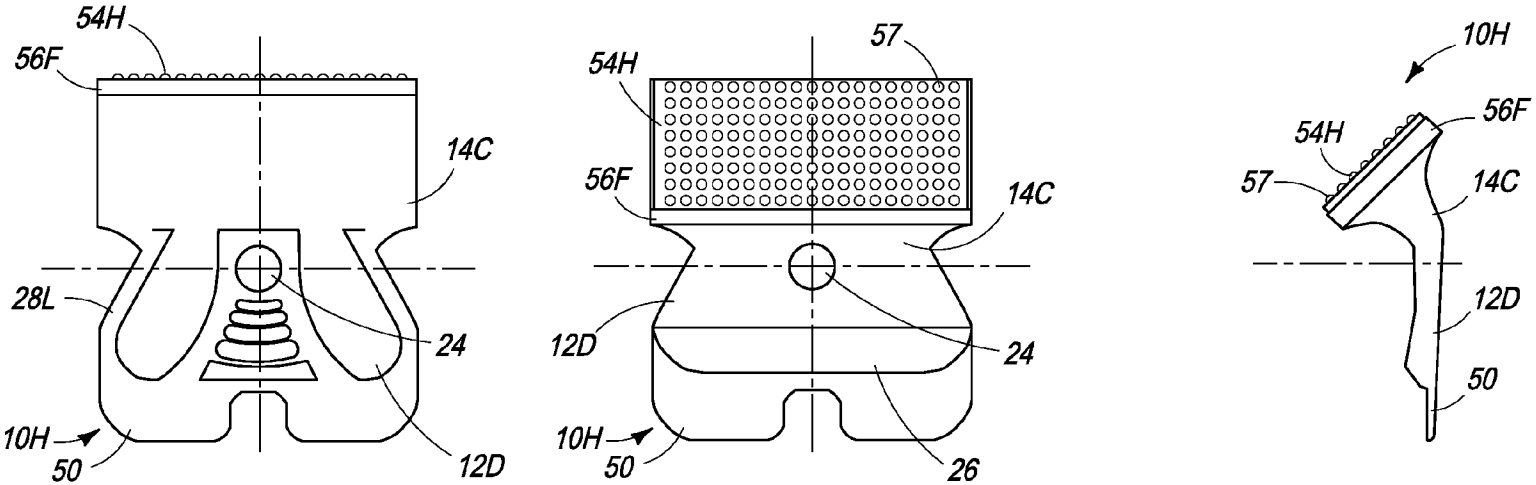
FIG. 40
FIG. 39
FIG. 38
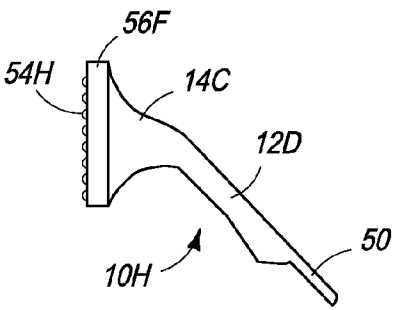
FIG. 42
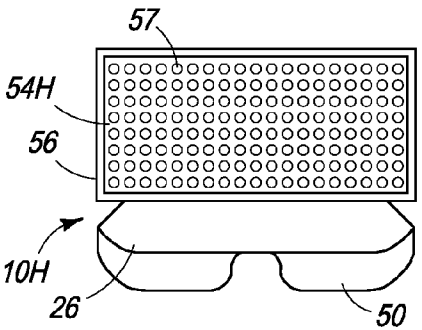
FIG. 41

TUBE TOOL DEVICE

CROSS-REFERENCE

This application is a continuation in part of U.S. patent application Ser. No. 11/412,054 filed Apr. 26, 2006 now U.S. Pat. No. 8,028,417 and further relies on U.S. Provisional Application No. 61/042,355 filed on Apr. 4, 2008 for priority.

FIELD OF THE INVENTION

The present invention is directed to a new and improved tool or implement holder, such as for a razor, employing a semi-rigid or flexible tube containing a composition, such as shaving cream, that works in association with the tool or implement, such as a razor blade attachment at the end of the tube which can receive and detachably secure a razor blade. The body of the tube serves as a handle for the tool or implement. Furthermore, in certain embodiments, the tube tool, together with its body, is detachable from the tube.

BACKGROUND OF THE INVENTION

There are many implements or tools used today that are used in association with a composition; and there are many compositions in use today that require or are preferably used with a tool or implement. For example, depilatories are normally used in conjunction with a scraper. Depilatory composition is applied to the area of interest, the depilatory composition is allowed to set for a set period of time, and then the composition, together with the depilated hair, is removed employing a scraper.

Similarly, compositions used to clean spots off of clothes or off fabrics or from rugs are applied to the soiled area, allowed to work in the soiled area to perform their action, and frequently the composition is worked into or rubbed in, or rubbed with a brush before removal to enhance cleansing. Grouting compositions are used to grout cracks or holes in surfaces, such as walls or ceilings, are applied to fill the crack or hole and then a blade is applied to smooth the grout so that it is even with the surface surrounding the hole or crack. Massage lotions are applied to the skin and then the massaging implement is worked over the skin with the lotion acting as a lubricant as well as performing other functions depending upon the composition of the lotion. Compositions are available for removing paint from surfaces, such as mirrors or windows. Compositions are available to soften materials to remove labels, and the like. The softening composition is applied to the surface of the material or to the label to act upon it, the composition is allowed to work on the material for a period of time, and then it is scraped off employing a planar scraper blade which can have a knife-edge or blunt edge with sharp 90 degree corners.

Paint, ink, coatings, waxes, and protective coatings are applied to an area frequently using a sponge. Some paint removers and polishers are applied to a surface and then after they have acted upon the surface, they are rubbed with sandpaper or a very fine polishing surface to either remove the paint or coating or to polish the surface.

Razors have traditionally comprised a frame with a fixed razor blade or a razor blade holder which is used to removably secure razor blades. Razors have been in use for over a century. The handle is normally elongated and shaped somewhat like a toothbrush handle. The head of the razors for replaceable razor blades is adapted to receive the particular type of razor blade that it is designed for. Although there are razor blades that can be received on a universal head, many razor blades can only be received or a proprietary head.

Shaving lotions come in cans, flexible tubes, semi-rigid tubes and in soap cakes. Shaving lather is normally applied to the skin when the skin is wetted. Preferably the skin has been prewashed to remove facial oils and bacteria. Earliest shaving lathers were lathered up from soft caked soap placed in the bottom of a mug, wetted with water and then lathered up with brush. The brush applied the lather to the face. Shaving lather caked soap is still available. In the 1930's, prepared lather creams started to appear. These lather creams were sold in flexible tubes, tubes similar to toothpaste tubes. The tubes were originally made from tin or lead or alloys thereof. Later tubes were made from aluminum. Today the tubes are made from plastic. Some lather creams were meant to be applied to a wet face directly with the hands or fingers. Other lather creams were made to be applied with a brush. These types of shaving lather creams are still available. In the 1960's, shaving foams became available in pressurized cans wherein the lather foam was released from the can by pressing the relief valve. The lather foam was released as a foaming mass which was applied to the face typically with the fingers and hands. This is the most common form of shaving lather used today.

With regard to volume and size, the cake soap shaving lather requires less room, but it also requires a container, such as a mug and a brush to utilize. Volumetrically, the shaving lathers that are available in aerosol cans require the most space and can be applied with the hands and fingers making them easy to use. Shaving lather creams available in tubes are easy to apply with the hands and fingers and require less than half the space of shaving lathers supplied in aerosol cans and work equally as well. They do not require a mug or brush.

Many women prefer to shave body hair in the bathtub or in the shower, and many men prefer to shave their beards in the shower. The bath and shower are not convenient for the use of cake soap shaving lather with a mug and brush. If the mug is dropped, it can break, since they are normally made of ceramic material. In addition, the mug can chip the bathtub or shower tile. The aerosol can has a disadvantage in that, if it is kept in the shower or around the tub, it gets wet and the metal of the aerosol rust causing rust stains in the tile grout and the like. In addition, if the can is dropped, it can ship the bathtub or shower tile. Thus, when shaving in the bathtub or in the shower, shaving lather cream that is contained within a flexible tube is preferred because a flexible tube is normally nonmetallic and can be dropped without breakage or chipping and can be left in or around the tub or shower without causing rust stains. The flexible tube of shaving cream is more convenient for travel because it requires less space than aerosol cans and does not require the use of a mug or brush for application.

One of the problems that is encountered by people when traveling is the amount of space required for their shaving gear including the razor blade with its frame and the shaving lather source, whether it is soap cake shaving lather applied with a brush or shaving lather applied from a flexible tube or shaving lather applied from an aerosol can. Another problem is that when people shave around the bathtub or shower, the separate components, the razor blade with handle and the source of the shaving cream, take up space which is normally in a premium around a bathtub or in a shower stall.

Thus, there is a need and there has been a need for a single unit shaving device which contains the shaving lather as well as functioning as a frame, support and handle for the razor blade.

Many compositions such as shaving cream, cleaning preparations, and the like, are thick or gelatinous materials that cannot easily be removed from a rigid bottle. These compositions are more easily applied from a flexible container having flexible or semi-rigid walls, such as a toothpaste tube.

Many compositions are supplied in flexible tubes with a separate tool or implement for use. The tube and tool or implement frequently get separated, and thus when the user wants to use the composition, they cannot find the implement or tool or vice versa. In addition, because of the relatively low cost for many compositions, tools are made cheaply and skimpily and do not have and adequate handle. It is object of the present invention to provide a flexible tube having flexible or semi-rigid walls for dispensing a composition for use and the implement or tools being secured to the flexible tube so that the implement or tool cannot be separated from the composition and the flexible tube can function as a large handle so that the implement or tool can be comfortably held and worked.

Furthermore, in another embodiment, there is a need for a single unit shaving device that can be detachably attached to, and used with, a flexible tube, where the tool is attached to a structure capable of holding the tool and the tube in a rigid, yet removable, relationship with each other. In such a case, during use the tool can be secured to the tube such that the implement or tool, while separable from the flexible tube, can still function as a large handle so that the implement or tool can be comfortably held and worked.

SUMMARY OF THE INVENTION

The present invention is directed to an improved razor for supporting and holding a razor blade and containing a shaving lather. The present invention comprises a semi-rigid flexible tube, such as the tubes disclosed in U.S. Pat. Nos. 5,871,020 and 6,053,184, which has secured to the end thereof a razor blade attachment unit. U.S. Pat. Nos. 5,871,020 and 6,053,184 are incorporated herein by reference. The razor blade attachment unit can have razor blade attachment plate of the universal type which can receive and detachably secure many of the razor blades produced by a number of companies or it can be an attachment unit that has been designed specifically for a particular razor blade. There are several proprietary razor blades that are produced which can only be received by a particular type or proprietary razor blade attachment assembly.

The present invention is also directed to a tool holder for a flexible tube comprising a frame adapted to be secured to the sealed end of the flexible tube, the frame having an attachment portion and a tool portion, the attachment portion having a first surface adapted to generally mate with the portion of the sealed end of the flexible tube, the tool portion having a tool holder adapted to receive a tool. The first surface can be adapted to be affixed to the sealed end of the tube by sonic or heating welding, or by adhesion, or by a friction fit. The tube holder can have at least one bore extending through the frame of the tool holder which is in registration with a bore through the sealed end. In one embodiment, a fastener, such as a rivet, is passed and secured through one or more bores of the frame and through bores in registration of the sealed end to secure the tool holder to the sealed end of the tube. In one embodiment of the invention, a tool holder is adapted to permanently receive a tool.

In an alternative embodiment of the present invention, a tool holder is adapted to removably receive a tool so the tool can be attached for use and removed. A tool can be a razor blade cartridge which is received on the tool holder. A tool can be brush which is affixed to the tool holder. A tool holder can be a cosmetic scraper which is roughly right angles to the main plane of the tool holder and the longitudinal axis of the flexible tube. The tool holder can be a stiff planar blade scraper extending roughly out in the main plane of the tool holder and parallel to or intersecting the longitudinal axis of the flexible tube. The scraper has a knife-edge or blunt edge with sharp corners. The tool holder can be a flexible planar blade extending roughly out in the main plane of the tool holder and parallel to or intersecting the longitudinal axis of the flexible tube and adapted to apply and smooth grouting. The tool can be a massager head affixed to the tool holder having a surface with protrusion extending therefrom for massaging tissue. The tool can be a brush or sponge affixed to the tool to spread, or smooth, or coat a surface with paint, ink, coatings, waxes, polishes, protective coatings, and the like to a surface. The tool can be a curved or planar support plate adapted to receive sandpaper which can be secured by an adhesive, or to a polishing pad comprising a soft fabric-like material which can be secured by an adhesive.

When the tool is a sponge, massager head, sandpaper device or polishing device with a polishing pad, the working surface of the brush, sponge massager head, sandpaper, and polishing pad are angled from the main plane of the tool holder and the longitudinal axis of the flexible tube normally about 45 degrees plus/minus 15 degrees. However, the working surface can be angled up to 90 degrees from the main plane of the tool holder and the longitudinal axis of the flexible tube. The longitudinal axis of the flexible tube is parallel to or lies in the main plane of the tool holder.

The alternative embodiment of the present invention comprises an implement holder and a flexible tube handle, the flexible handle comprising a flexible tube having semi-rigid or flexible walls. The tube holder comprises a frame adapted to be secured to the sealed end of the flexible tube, the frame having an attachment portion and a tool portion, the attachment portion having a first surface adapted to generally mate with a portion of the sealed end of the flexible tube, the tool portion having a tube holder adapted to receive a tool or having a tool affixed thereto. In one embodiment, the first surface is affixed to the sealed end of the flexible tube. In another embodiment, the forme of the tool holder is secured to the flexible tube by a fastener(s), such as rivet(s). The tool portion can be a razor blade cartridge, it can be a brush, it can be a stiff planar blade scraper, it can be a cosmetic scraper, it can be a flexible planar blade grouter, it can be a massager head, it can be a support plate with a planar or curved surface adapted to hold sandpaper, emery cloth, or a polishing pad, and the like. The flexible tube is adapted to receive a composition to be used in association with the tool and is dispensed from the flexible tube from the applicator end opposite the sealed end.

In one embodiment of the present invention, the invention is a shaver comprising a tool holder for a flexible tube adapted to contain shaving cream used in connection with the shaver. In another embodiment of the present invention, the invention is a cleaning device comprising a tool holder for a cleaning implement, such as a brush, and a flexible tube adapted to receive cleaning compositions which are used in connection with the cleaning implement. In another embodiment of the present invention, the invention is a scraper device comprising a tool holder for a scraper, and a flexible tube adapted to contain compositions for removal or softening of materials from surfaces used in conjunction with the scraper device. The compositions for removal of materials from surfaces can be paint removers, softening compositions for removing adhesive materials, hydrocarbon, or halogenated compositions for removal of tar, oil and greases from surfaces, and the like.

In another embodiment of the present invention, the invention is directed to a caulking device comprising a tool holder for a caulking blade, and a flexible tube adapted to contain caulking composition used in connection with the caulking blade. The caulking blade is normally a flexible planar blade used for applying caulking to cracks and holes for smoothing the caulking so that the surface of the caulking material is contiguous with the surface surrounding the crack or hole.

In another embodiment of the invention, the invention is directed to a cosmetic scraper comprising a tool holder for a cosmetic scraper, and a flexible tube adapted to contain depilatory compositions for the removal of hair from skin, which is used in connection with the cosmetic scraper.

In another embodiment of the invention, the invention is directed to a massager comprising a tool holder for a flexible tube adapted to contain massage lotions in connection with the massager.

In another embodiment of the invention, the invention is directed to a device comprising a tool holder for a flexible tube adapted to contain paint, ink, coatings, waxes, polishes, protective coatings and other coating used in connection with a sponge secured to the tool. The sponge can be secured to the tool holder with an adhesive backing so that the sponge can be replaced with fresh sponges as the need arises.

In still another embodiment of the present invention, the invention is directed to a device comprising a tool holder for a flexible tube and adapted to contain paint remover or polish used in conjunction with sandpaper or a polisher pad secured to the tool holder. Preferably, the sandpaper or polishing pad is secured to the tool holder with self-adhesive backing so that the sandpaper or polishing pad can be removed and replaced as the need arises.

Another embodiment of the present invention comprises an implement holder and a flexible tube handle, the flexible handle comprising a flexible tube having semi-rigid or flexible walls. The tube holder comprises a frame adapted to be removably secured to the sealed end of the flexible tube, the frame having an attachment portion and a tool portion, the attachment portion having a first surface adapted to generally encircle and/or grip a portion of the sealed end or body of the flexible tube and the tool portion having a tube holder adapted to receive a tool or having a tool affixed thereto. The tool portion can be a razor blade cartridge, it can be a brush, it can be a stiff planar blade scraper, it can be a cosmetic scraper, it can be a flexible planar blade grouter, it can be a massager head, it can be a support plate with a planar or curved surface adapted to hold sandpaper, emery cloth, or a polishing pad, and the like. The flexible tube is adapted to receive a composition to be used in association with the tool and is dispensed from the flexible tube from the applicator end opposite the sealed end. In one embodiment, the applicator head comprises a foam applicator surface that is secured to the tube using a plurality of protusions, such as barbs.

In one embodiment, the present invention is a tube tool structure comprising a tool device, a frame wherein said frame comprises a plurality of members that form a space capable of removably receiving at least one end of a semi-rigid tube, and a platform that is physically attached to said tool device and said frame, wherein a combination of said frame, platform and tube provides a handle for using said tool device. The tool device is one of a razor, brush, scraper, blade, massager head, brush, sponge, support plate for sandpaper, or polishing device. The tool device is integrally formed as part of the tube tool structure. The tool device is removably attachable to the platform. A hole extends through the platform connecting the frame to the tool device.

Optionally, the frame has a pair of ribs that form left and right sides of the frame and join at the top to form a neck culminating into said platform for supporting the tool device, wherein the ribs define a substantially triangular portion therebetween for receiving an end of a tube and wherein said frame further comprises a downwardly extending helical arm.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein outer ends of said ribs extend downwards to form two vertical sides which join at the bottom to form a front horizontal rib and a back horizontal rib.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein outer ends of the ribs extend downwards to form two vertical sides.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein a single elongated member extends downward from at least one of said ribs, said elongated member terminating in a curved member that defines a space for receiving a portion of said tube.

Optionally, the frame has a pair of ribs that form left and right sides of the frame and join at the top to form a neck culminating in the platform for supporting the tool device, wherein the ribs define a substantially triangular portion therebetween for receiving an end of the tube.

In another embodiment, the present invention is directed to a kit that comprises a semi-rigid tube having an end with an opening and an end that is sealed, a tube tool structure, wherein said tube tool structure is removably attachable to a portion of the semi-rigid tube, comprising: a tool device, a frame wherein said frame comprises a plurality of members that form a space capable of removably receiving at least one end of the tube and a platform that is physically attached to said tool device and said frame, wherein a combination of said frame, platform and tube provides a handle for using said tool device.

Optionally, a plurality of elongated protrusions are positioned within the opening of said tube. The elongated protrusions are integrally formed into a ring and wherein said ring is snap fitted into said opening. Alternatively, the elongated protrusions are inserted into holes positioned in side walls of said opening.

Optionally, the frame has a pair of ribs that form left and right sides of the frame and join at the top to form a neck culminating into said platform for supporting the tool device, wherein the ribs define a substantially triangular portion therebetween for receiving an end of a tube and wherein said frame further comprises a downwardly extending helical arm.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein outer ends of said ribs extend downwards to form two vertical sides which join at the bottom to form a front horizontal rib and a back horizontal rib.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein outer ends of the ribs extend downwards to form two vertical sides.

Optionally, the frame has a pair of ribs that form left and right sides of the frame and join at the top to form a neck culminating into the platform for supporting the tool device, wherein the ribs define a substantially triangular portion therebetween for receiving an end of the tube and wherein a single elongated member extends downward from at least one of said ribs, said elongated member terminating in a curved member that defines a space for receiving a portion of said tube.

Optionally, the frame has a pair of ribs that form left and right sides of the frame and join at the top to form a neck culminating in the platform for supporting the tool device, wherein the ribs define a substantially triangular portion therebetween for receiving an end of the tube.

BRIEF DESCRIPTION OF THE DRAWINGS

FIG. 17 is a front plan view of a cosmetic scraper unit of the present invention;

FIG. 18 is a back plan view of the cosmetic scraper unit of FIG. 17;

FIG. 19 is a left plan side view of the cosmetic scraper unit of FIG. 17;

FIG. 20 is a front plan view of a planar blade attachment unit of the present invention;

FIG. 21 is a back plan view of the planar blade attachment unit of FIG. 20;

FIG. 22 is a left plan side view of the planar blade attachment unit of FIG. 20;

FIG. 38 is a front plan view of a massager attachment unit of the present invention;

FIG. 39 is a back plan view of the massager attachment unit of FIG. 38;

FIG. 40 is a left plan side view of the massager attachment unit of FIG. 38;

FIG. 41 is a top view of looking into a massaging head of FIG. 40;

FIG. 42 is another left plan side view of the massager attachment unit of FIG. 38;

DETAILED DESCRIPTION OF THE PRESENT INVENTION

Figure 3:
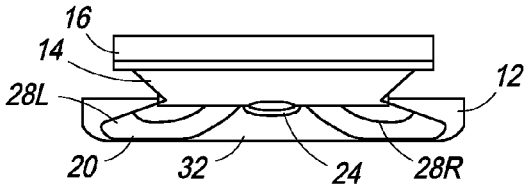
FIG. 3 is a top view of the unit of FIG. 1.
Figure 5:
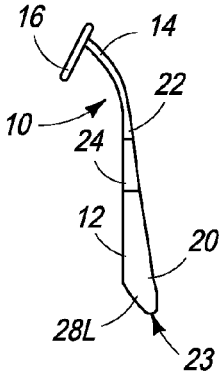
FIG. 5 is a left plan side view of the unit of FIG. 1.
Figure 1:
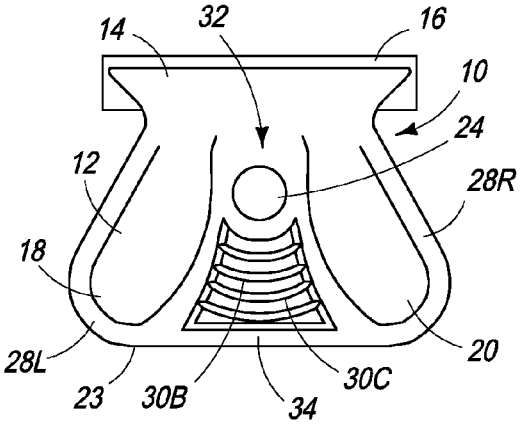
FIG. 1 is a front plan view of the razor blade attachment unit of the present invention.
Figure 6:
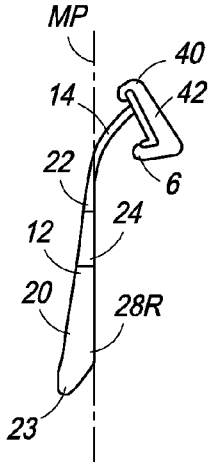
FIG. 6 is a right side plan view of the unit of FIG. 1 with a razor blade attached.
Figure 4:
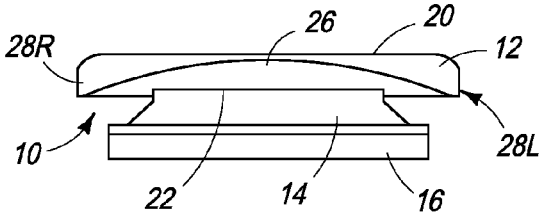
FIG. 4 is a bottom view of the unit of FIG. 1.
Figure 2:
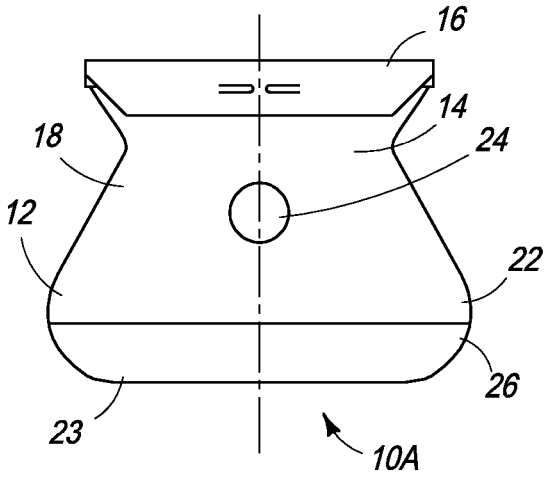
FIG. 2 is a back plan view of the unit of FIG. 1.
Figure 7:
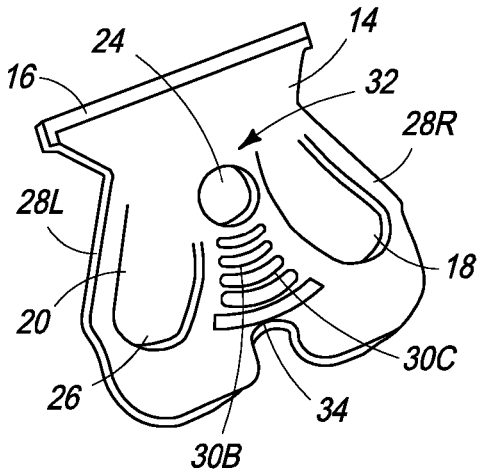
FIG. 7 is a left perspective view of the front side of the unit of FIG. 1.
Figure 8:
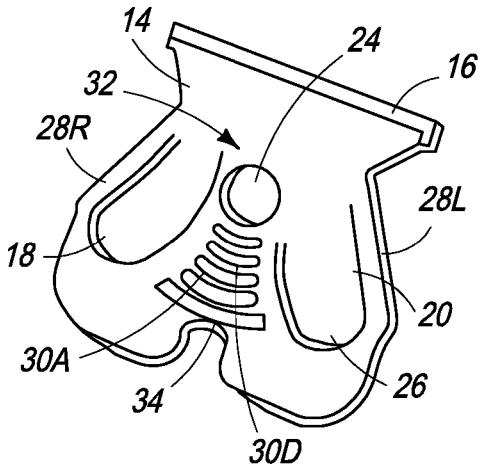
FIG. 8 is a right perspective view of the front side of the unit of FIG. 1.

Referring to FIGS. 1-8, the razor blade attachment unit 10 comprises a frame 12 having an arm 14 extending upwardly and outwardly there from and a razor blade attachment plate 16 secured to the end of the arm 14. Alternatively, a proprietary razor blade attachment assembly can be used (not shown). The razor blade attachment plate 16 can be a universal attachment plate which will receive most razor blades manufactured today. However, some razor blades cannot be secured by the universal attachment plate and the proprietary attachment assembly must be used for the attachment of such blades if they are to be used.

The frame 12 has a ribbed front side 20 and a planar back side 22. A hole 24 extends through the frame from the ribbed front side to the planar back side adapted to receive a hanger to support the razor or a fastener, such as a rivet, to secure the frame to the sealed end or flexible tube. The ribbed front side 20 has a pair of U-shaped ribs 28R and 28L on the right side and left side, respectively, of 26 the frame that extend downwardly from the outer ends of the arm to the bottom of the frame where they curve in a U-shaped manner and extend upwardly again where they join to form a platform 32 which is connected to the arm 14. The frame 12 has a planar wall 18 which is recessed with respect to the front of the U-shaped ribs. The back side of the planar wall 18 defines the planar back side 22. On the planar back side 22 at the base 23 of the frame 12, the surface of the back side is cut inwardly to form an arcuate scalloped wall portion 26. This portion is scalloped to receive the bulging wall of the shaving cream semi-rigid tube. The use of the ribs in conjunction with the planar wall provides a frame that is strong and light weight and minimizes the use of materials and is yet rigid enough to perform the desired function.

To both reinforce the razor blade attachment unit 10 and to add a decorative feature to the unit, portions of the U-shaped ribs are stiffened and reinforced with respect to each other by the platform 32 and with a series of arcuate ribs 30A through SOD. At the base of the frame 12, a base rib 34 extends from the base of the U-shaped ribs to further stiffen and reinforce the unit. The frame 12 is relatively rigid or stiff because of the planar wall 18, the U-shaped ribs 28R and 28L, and arcuate ribs 30A through SOD, and the base rib 34. The arm 14, being a curved sheet-like structure has a limited degree of flexibility to assist the attached razor blade (see FIG. 6) to follow the contour of the skin during shaving.

Figure 9:
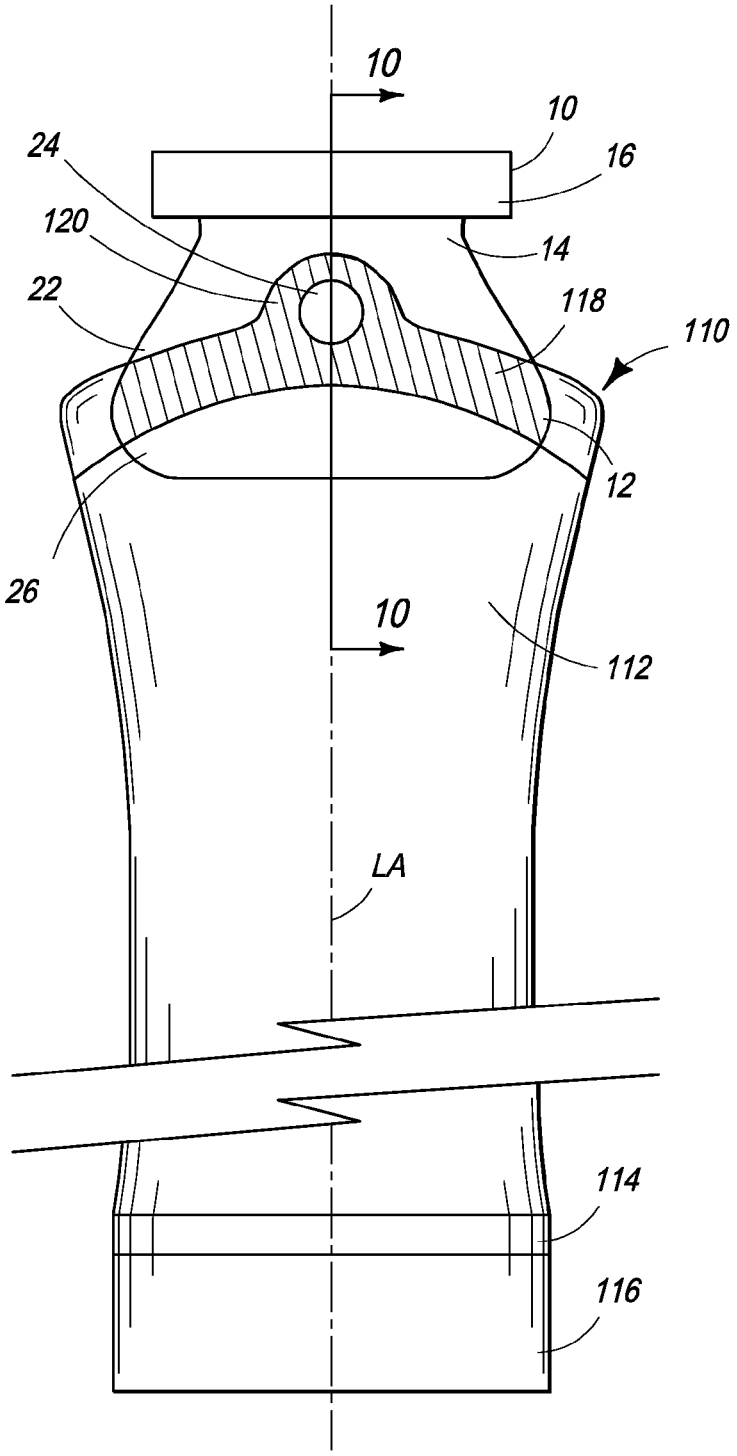
FIG. 9 is a back plan view of the razor of the present invention.
Figure 10:
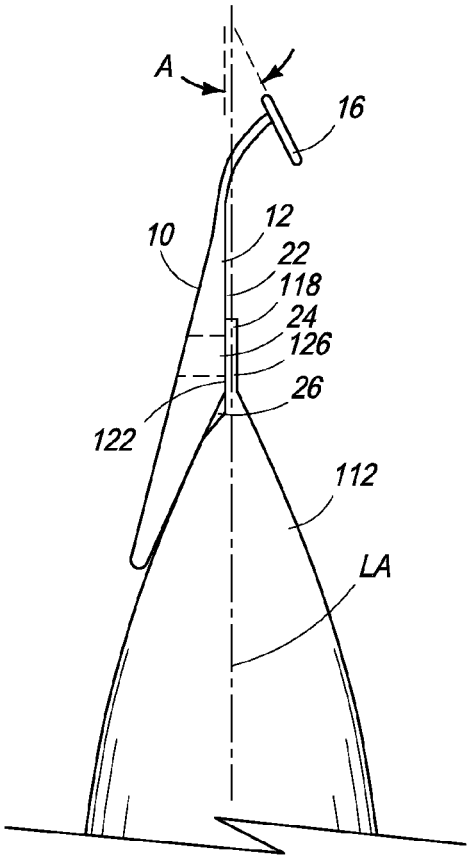
FIG. 10 is an enlarged fragmentary plan side view of the end portion of the razor taken along lines 10-10 of FIG. 9.
Figure 47:
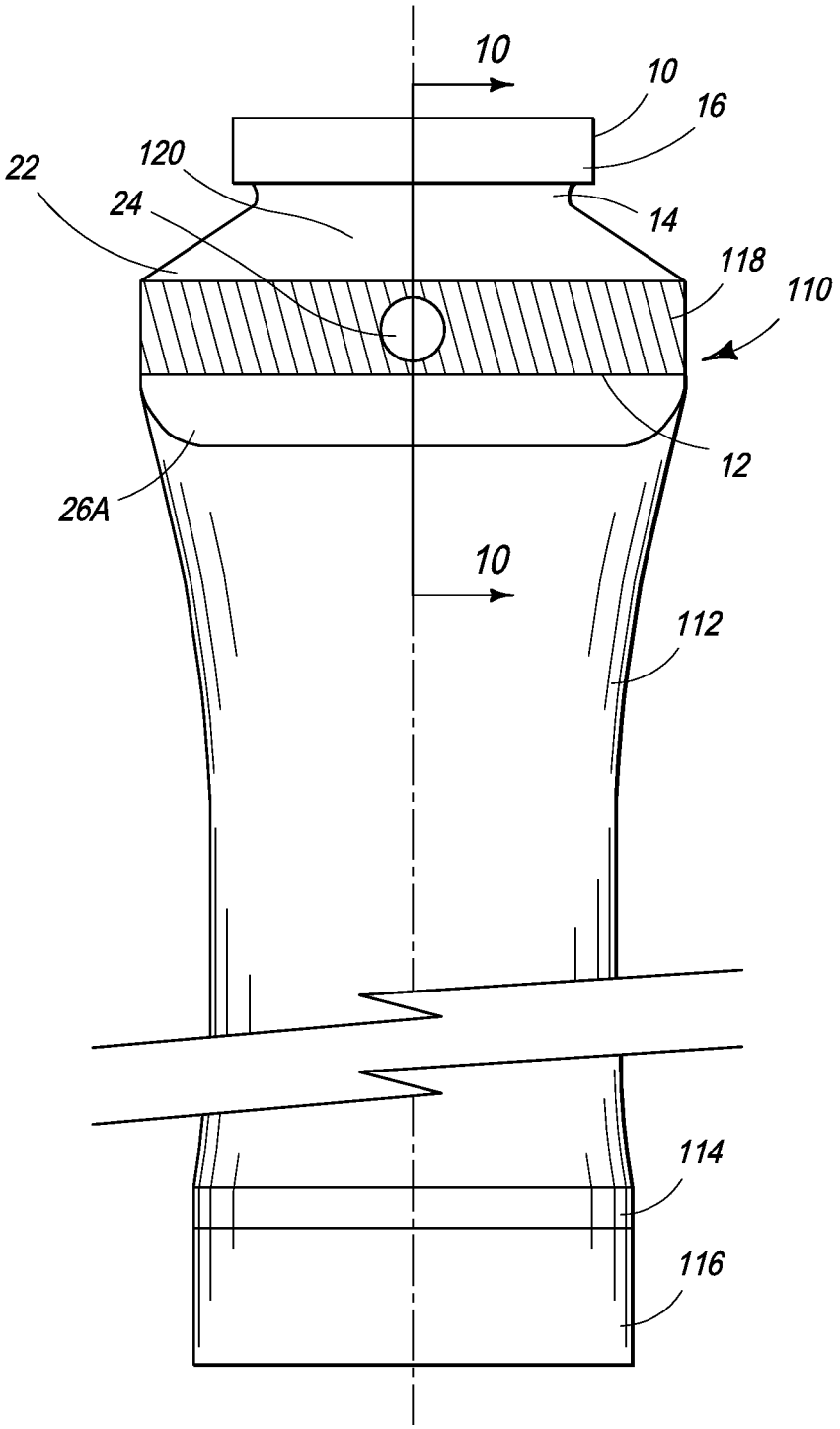
FIG. 47 is a back plan view of another embodiment of the present invention.

Referring to FIGS. 9 and 10, the razor blade of the present invention comprises the razor blade attachment unit 10 and the semi-rigid tube 112. The flexible or semi-rigid tube 112 conveniently contains shaving cream which can be forced out of the flexible tube through the applicator head 116, which is attached to the tube via connector portion 114. The shaving cream can be applied to the face employing the applicator head. This eliminates the need to use the hands or fingers for application of the shaving cream. The applicator heads are described in U.S. Pat. Nos. 5,871,020 and 6,053,184, the disclosures for which are incorporated herein by reference. The invention is not limited to flexible tubes having applicator heads. Flexible tubes with conventional heads, such as seen on toothpaste tubes, shaving cream tubes, etc., can be used. The end of the flexible or semi-rigid tube 112 is sealed to form an end seal 118. The end seal can be arcuate as seen in FIG. 9 and adapted to mate with arcuate scallop wall portion 26 of razor blade attachment unit 10. However, the end seal can also be nonarcuate, that is straight,~as seen in FIG. 47. This is adapted to mate with a nonarcuate or straight scallop wall portion 26A seen in FIGS. 13, 18, 21, 24, 26, 29, 31, 34, 36, 39, 41, and 45. The end seal is conveniently sealed by sonic welding although heat welding, plasma welding or suitable adhesives can also be used. The planar back side 22 of the razor attachment unit 10 is secured to the end seal 118 of the semi-rigid tube 112 in the attachment area 122 (shown in cross hatching in FIGS. 9 and 47) by sonic welding, heat welding, plasma welding an adhesive, or by a rivet passing through the hole 124 and a hole 126 in registration with hole 124. Sonic welding has been found to be quite satisfactory. The bulge of the flexible tube adjacent to the seal end 118 is accommodated in the scallop wall portion 26 (26A in FIG. 47) of the razor blade attachment unit 10 which permits the planar back side 22 of the razor blade attachment unit 10 to be somewhat in plane or somewhat parallel with the longitudinal axis of the semi-rigid tube 112. This positions the razor blade attachment plate 16 and the razor blade received therein correctly with respect to the semi-rigid tube handle 112. The angle A is preferably about 25°±5°. Although the scallop wall portion can be secured to the outer wall of the flexible tube, it has not been found necessary by the applicant and such attachment is optional. The hole 24 extends through the razor blade attachment unit 10 as described above and through the hole 126 in the head portion 120 and the end seal 118. This hole can be utilized for hanging the razor 110 on hooks in retail establishments for display and presentation for purchase, or it can receive a rivet or other securing attachment to secure the unit 10 to the flexible tube 112.

Although it is anticipated that the unit will be sold with a razor blade attached, the razor can be sold and transported or stored without a razor blade secured to the razor blade attachment plate 16. When the razor is to be utilized, a razor blade 40 can be slide on to the plate 16 in the conventional manner. The plate can be designed to detachably lock and secure the razor blade 40 on to the plate. When an operator wishes to replace the razor blade, take the razor blade out for any reason, the razor blade 40 can be slid off the plate 16. The attachment plate 16 can also be designed to permanently receive a razor blade which would prevent removal of the razor blade from the plate 16. In the razor blade illustrated in FIG. 6, the razor blade has three blades 42. Some razor blades have a single blade, others have two or more blades, and they can also be utilized on the present razor 110.

Figure 11:
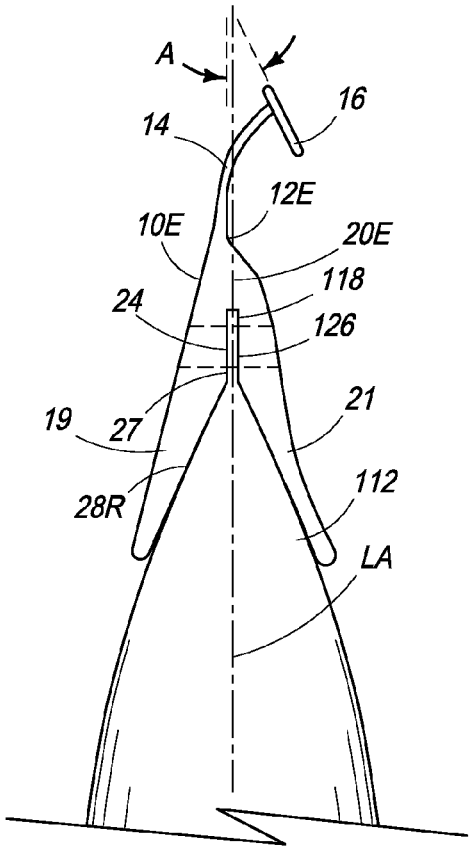
FIG. 11 is an enlarged fragmentary plan side view of the end portion of another embodiment of the applicator head attached to the flexible tube, similar to FIG. 10.
Figure 14:
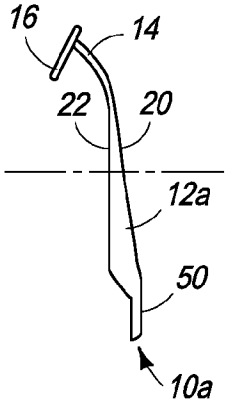
FIG. 14 is a left plan side view of a razor blade attachment unit of FIG. 12.
Figure 13:
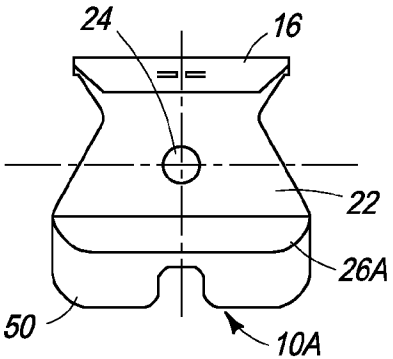
FIG. 13 is a back plan view of the razor blade attachment unit of FIG. 12.
Figure 16:
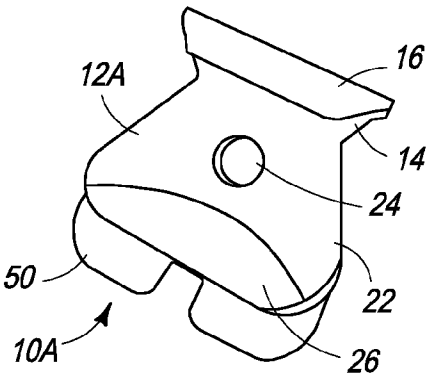
FIG. 16 is a back perspective view of the razor blade attachment unit of FIG. 13.
Figure 12:
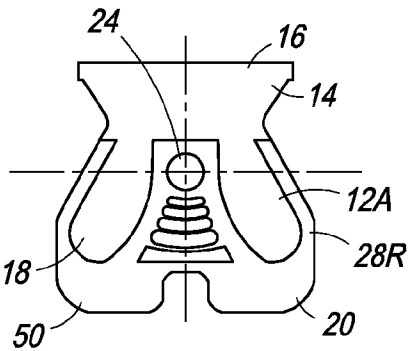
FIG. 12 is a front plan view of a razor blade attachment unit of the present invention.
Figure 15:
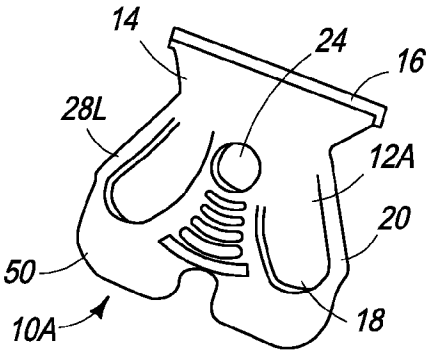
FIG. 15 is a front perspective view of the razor blade attachment unit of FIG. 12.
Figure 25:
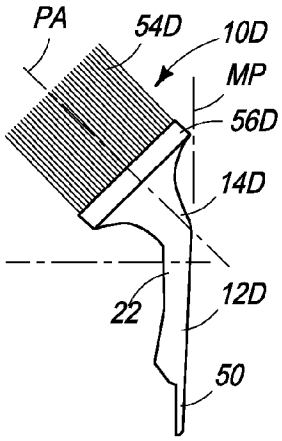
FIG. 25 is a left plan side view of the brush attachment unit of FIG. 23.
Figure 24:
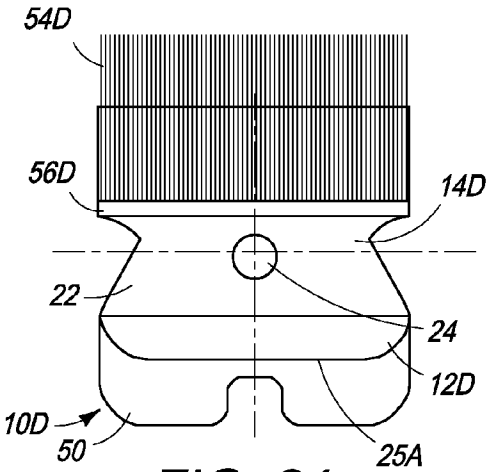
FIG. 24 is a back plan view of the brush attachment unit of FIG. 23.
Figure 23:
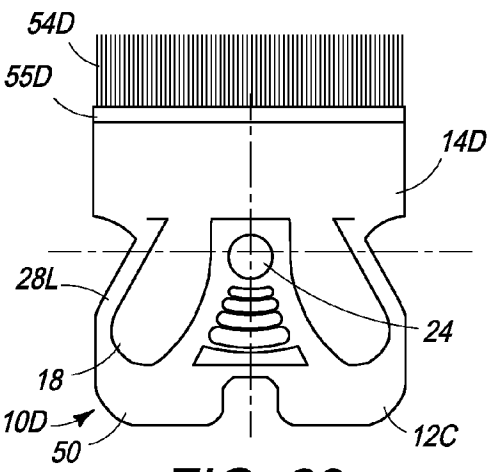
FIG. 23 is a front plan view of a brush attachment unit of the present invention.
Figure 27:
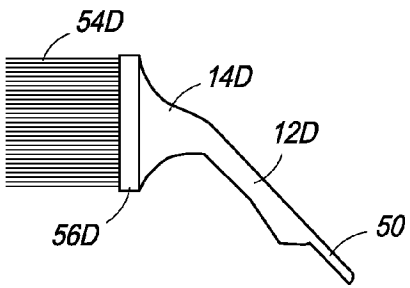
FIG. 27 is another left plan side view of the brush attachment unit of FIG. 23.
Figure 26:
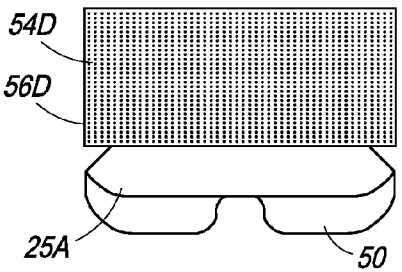
FIG. 26 is a top view looking down into bristles of brush attachment unit of FIG. 25.
Figure 30:
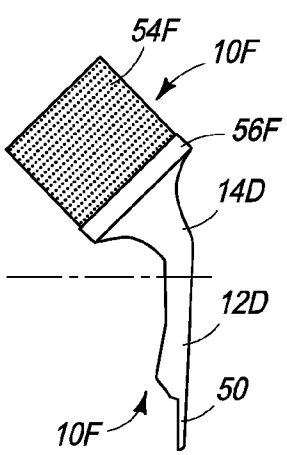
FIG. 30 is a left plan side view of the sponge attachment unit of FIG. 28.
Figure 29:
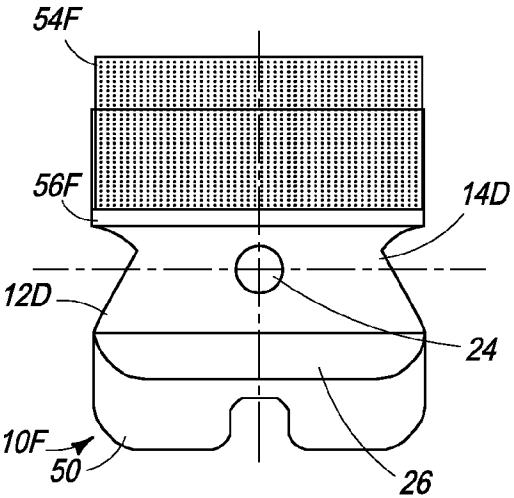
FIG. 29 is a black plan view of the sponge attachment unit of FIG. 28.
Figure 28:
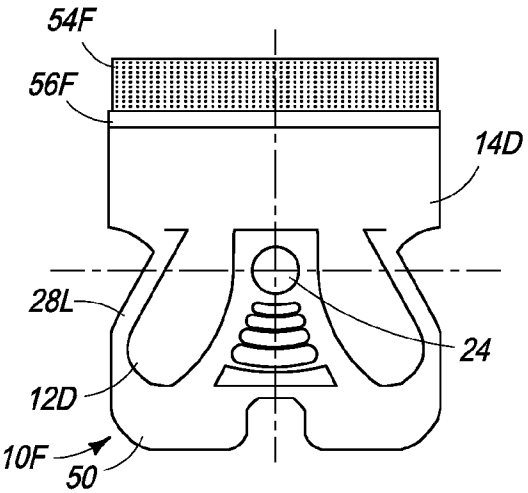
FIG. 28 is a front plan view of a sponge attachment unit of the present invention.
Figure 32:
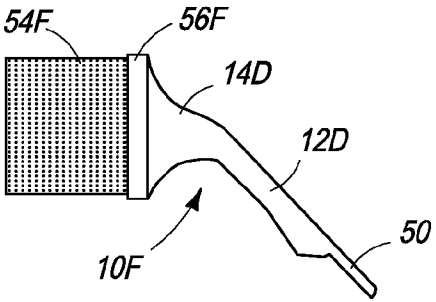
FIG. 32 is another left plan side view of the sponge attachment unit of FIG. 28.
Figure 31:
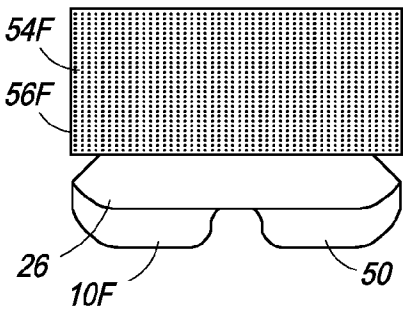
FIG. 31 is a top view looking into the sponge head of FIG. 30.
Figure 35:
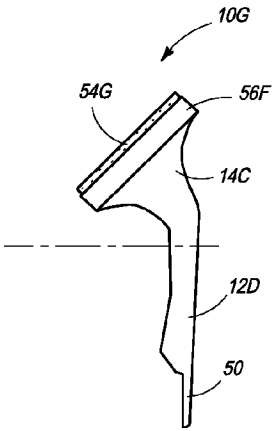
FIG. 35 is a left plan side view of the sandpaper/polishing pad attachment unit of FIG. 33.
Figure 34:
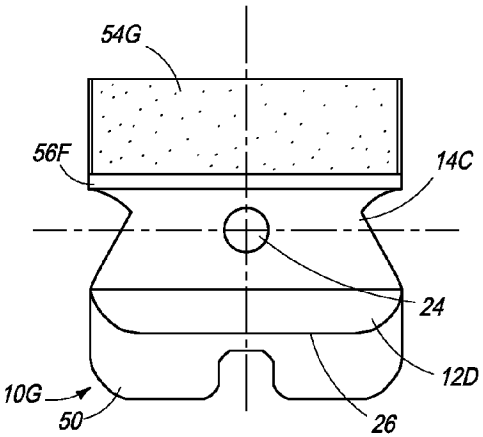
FIG. 34 is a back plan view of the sandpaper/polishing pad attachment unit of FIG. 33.
Figure 33:
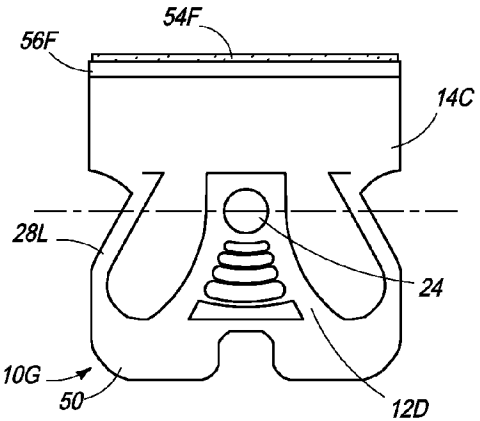
FIG. 33 is a front plan view of a sandpaper/polishing pad attachment unit of the present invention.
Figure 37:
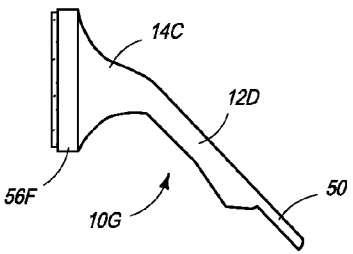
FIG. 37 is another left plan side view of the sandpaper/polishing pad attachment unit of FIG. 33.
Figure 36:
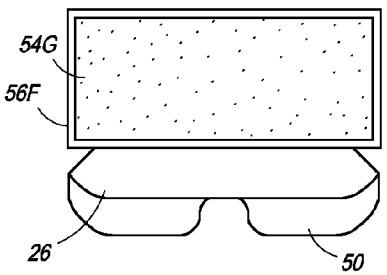
FIG. 36 is a top view looking into the sandpaper/polishing pad attachment unit of FIG. 35.
Figure 43:
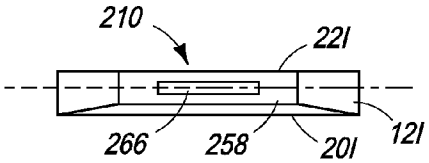
FIG. 43 is a top end view of the tool unit of FIG. 44.
Figure 44:
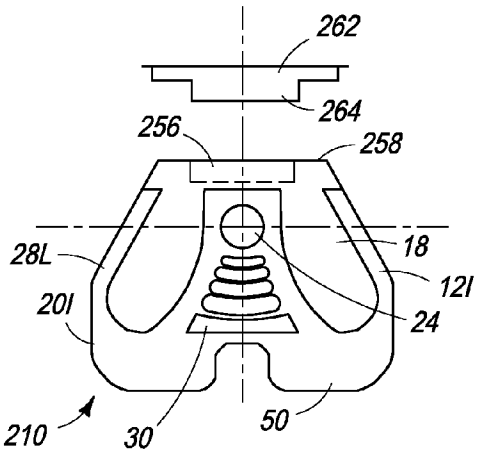
FIG. 44 is a front plan view of the tool attachment unit of the present invention.
Figure 45:
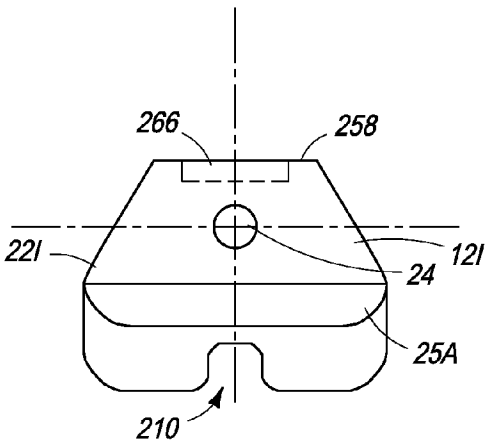
FIG. 45 is a back plan view of the tool unit of FIG. 44.
Figure 46:
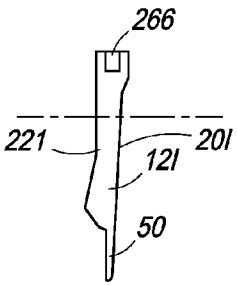
FIG. 46 is a left side of the tool attachment unit of FIG. 44.

Referring to FIG. 11, another embodiment of the razor of the present invention is illustrated. The elements of this embodiment, which are identical to the elements of the razor shown in FIGS. 9 and 10, have the same drawing numbering. The razor attachment 10E has a front wall 21 extending from the frame 12B and a slot 27 is formed between the back wall 19 and the front wall 21. The slot 27 is adapted to securely receive the sealed end 118 of the flexible tube 112 in a friction fit or pinch fit. The walls of the slot 27 can have protrusions or teeth (not shown) to firmly grip the sealed end 118 to prevent the razor attachment unit 10 from being removed from the flexible tube 112. Additionally, the razor attachment unit can be secured to the sealed end by sonic welding, heat welding, plasma welding, or adhesive between the walls of the slot and the sealed end, or by a rivet passing through the hole 124 and a hole 126 in the sealed end which is in registration with hole 124.

Referring to FIGS. 12-16, another alternative embodiment of the razor attachment unit 10A is illustrated. The elements of the razor attachment unit 10A which are identical to the elements of razor attachment unit 10 are shown with the same drawing numbers. The principal difference between the razor attachment unit 10A from that of razor attachment unit 10 is the addition of the extended braces or supports 50 which extend down from the front of the frame 12A to provide further support of the razor attachment unit with respect to the flexible tube 112 (see FIG. 10). When force is applied to the razor attachment 16, such as during shaving, the attachment between unit 10 and the sealed end 118 acts as a pivot point and the arm between the point of attachment and the razor attachment head 16 acts as a fulcrum or lever arm which forces the bottom portion of the frame 12 against the side of the flexible or semi-rigid tube 112 which could collapse the side of the tube which could render the tube's effectiveness as a tool handle. The braces or support 50 of the razor attachment unit 10 FIGS. 12-16 increases the surface area of the bottom portion of the frame 12A and braces the frame and resists pivoting of the frame at the point of attachment of the frame and the sealed end, and forcing the bottom of the frame into the side of the tube.

The flexible tubes 112 are made of plastic such as polyethylene and polypropylene. The flexible tubes can be co-extruded tubes which are multilayered tubes made of plastic and/or meal. These tubes can be made in a variety of flexibilities from being very flexible to being semi-rigid. In fact, they can be made quite rigid. But rigid wall tubes are undesirable because they can make it difficult, if not impossible, to dispense the contents therein, especially for thick compositions. Thus, it is anticipated that the attachment will be used on either flexible or semirigid tubes. For flexible wall tubes, the movement or pivoting of the razor attachment unit with respect to the sealed end is a minor problem when the tube is filled with content. However, when a third or more of the contents have been evacuated from the tube, the razor attachment unit with sufficient force can partially or fully collapse the side of the tube as the unit pivots at the point of attachment as the razor is used. The razor attachment unit 10A has less of a tendency to pivot and collapse the side of the tube than the razor attachment unit 10 when used on a partially filled flexible tube.

Referring to FIGS. 17-19, the attachment unit can be designed for a variety of purposes. The unit shown in FIGS. 17-19 is a cosmetic scraper attachment unit used for scraping surfaces. The scraper head 16A will be integral with the scraper attachment unit 10B. The scraper head 16A can have a blunt edge or a knife-edge edge or an edge in between. The components or elements of scraper attachment unit 10B, which are identical to the same elements in razor attachment unit 10, are identified with the same drawing numbers. The scraper head 16A can be utilized for a number of applications. It is contemplated using the scraper attachment unit 10B with a tube 112 containing a depilatory agent for removal of hair from the body. The depilatory agent will be applied to the surface of the skin which bears the unwanted hair, allowed to work depilate the hair and then the composition and the depilated hair will be removed by employing the scraper to scrape off the composition and the depilated hair. After the operation is complete, hair and composition adhering to the scraper head 16A can be easily removed with water to leave a clean scraper attachment unit. The resiliency of the neck 14A can be adjusted either in thickness and/or in the composition used to manufacture the scraper attachment unit so that the semi-rigid neck that has sufficient resiliency so that the scraper head rides over imperfections on the surface of the skin.

Referring to FIGS. 20-22, a planar blade attachment unit 10C is illustrated. The elements of the blade attachment unit 10C and the razor attachment unit 10, which are identical, have been identified by the same drawing numbers. With proper design and manufacture, the blade attachment unit 10C can be utilized as a scraper or a grouting blade 52. When the blade 10C is to be utilized as a grouting blade, the blade 52 will be relatively pliable or flexible and normally will have a blunt squared-off edge 53. When blade 10C is a grouting blade, it can be utilized to apply grout or filler from the flexible tube to cracks, holes and the like. When the blade 10C is to be utilized as a scraper, such as a scraper to remove paint or other materials, blade 52 will be relatively rigid and the edge 53 will be a sharp edge, like a knife-edge, or a squared-off edge 53 with sharp edges and corners. When blade attachment unit 12C is a grouting blade, the grout will be stored within the flexible tube. In use, the grouting material will be dispensed from the tube into the crack or hole and the grouting material will be forced into the crack or hole and smoothed with respect to the surface surrounding the crack or hole employing the grouting blade 52. When the blade attachment unit 12C is a scraper, the flexible tube will contain composition used to soften, lift or remove material, such as paint, label adhesive, tar, and the like. The composition will be dispensed from the tube onto the material that is to be softened or removed. The composition is given sufficient time to work on the material, then the material is scraped off employing the scraper blade 52. The scrapers are illustrated with working ends perpendicular to the longitudinal axis of the blade. The working edge can be angled 53A (in phantom FIG. 20) to the longitudinal axis of the blade.

Referring to FIGS. 23-27, a brush attachment unit 10B is illustrated. The elements of the brush attachment unit 10B, which are common with the razor attachment unit 10, are identified by the same figure numbers. The brush attachment unit 10B has a bristle support plate 56 on which bristles 54 are supported. The bristles support plate 56 is connected to the frame 12C by the rigid neck 14C. The bristles can be molded into or with the bristle support plate at the same time the brush attachment unit frame is molded, or they can be added later. The bristles can be plastic, fiber, metal, or the like. In one embodiment, the bristles and bristles support plate 56 are manufactured separately and secured to the neck 14C by sonic welding, heat welding, adhesive, or the like. The bristles can be stiff or they can be flexible, depending upon the intended use of the brush attachment unit. One use is for cleaning wherein the tube 112 contains a cleaning composition which is dispensed onto the area to be cleaned and the cleaning composition is worked into the area that is to be cleaned, such as a spot on a fabric or rug, to remove a spot. A brush attachment unit can also be employed to coat a surface with composition contained in the tube, such as a protective coating, paint, ink, and the like.

Referring to FIGS. 33-37, a sandpaper/polishing pad attachment unit 10G is illustrated. The elements of the sandpaper/polishing attachment unit 10G which are common with the razor attachment unit 10, are identified by the same drawing or figure numbers. The sandpaper/polishing pad attachment unit 10G has a support plate 56A which supports the sandpaper or polishing pad. The sandpaper or polishing pad can be secured permanently to the support plate 56F, or they can be attached by an adhesive layer on the back of the sandpaper or pad. In that event, the sandpaper or polishing pad can be removed from the support plate and replaced with a fresh sandpaper or polishing pad when the need arises. Sandpaper comes in many grades, such as a very rough grade 10 and a very fine grade 1200. For the removal of paint or the like, a very rough grade is utilized. For a very fine finish, a very fine paper is used, such as the 1200 grade. The polishing pad can be a natural fiber pad such as a cotton or wool pad, a synthetic fiber pad such as a polyester or nylon pad, or it can be a smooth fiber-reinforced paper pad, or the like. The support plate 56F is connected to the frame 12D by the rigid neck 14D. The support plate can have a planar surface or a curved surface (not shown) and it can be rigid or resilient or flexible. In one embodiment, the support plate 56A can be manufactured separately and secured to the neck 14D by sonic welding, heat welding, adhesive, or the like.

Referring to FIGS. 38-42, a massage attachment unit 10H is illustrated. The elements of the massage attachment unit 10H, which are common with the razor attachment unit 10, are identified by the same figure numbers. Massage attachment unit 10H has a support plate 56F on which a massage head 54H is attached. Massage head 54H has a plurality of protrusions 57 for massaging tissue, especially the skin. Protrusions 57 come in a variety of sizes and shapes. Protrusions can be teeth-like with blunt heads and the teeth can be relatively flexible or inflexible (not shown), the protrusions can be elongated thick bristle-like structures (not shown), protrusions 57 can be half-round protrusions as illustrated in FIGS. 38-42, and the like. The support plate 56F is connected to the frame 12D by the rigid neck 14D. The massage head 54H normally is made of an elastomeric relatively soft material. The support plate can have a rectangular footprint as shown, or a round, square, oval, and the like, footprint. The support plate can have a planar surface or a curved surface (not shown) and it can be rigid or resilient or flexible. The massaging head 54H can be molded at the same time the massaging attachment unit frame is molded, or it can be molded with the support plate 56F as a separate unit distinct from the frame 12D, or it can be added later to the support plate 56 with adhesive. In the latter case, the massage head can be permanently attached to the support plate, or it can be removably secured to the support plate with a non-hardening adhesive coating on the back of the massage head. In that case, the massage head can be removed and replaced with another massage head as the need arises, such as to change the shape of the massage head for a different type of massaging action.

Referring to FIGS. 43-47, a universal implement attachment unit 210 for flexible tubes is illustrated. The elements of the attachment unit 210, which are identical to the elements of the razor attachment unit 10, are illustrated with the same drawing numbers. The attachment unit 210 has a top portion 258 with a female receptacle 266 which is adapted to receive the male extension 264 of the implement 262. The female receptacle 266 receive the male extension 264 either in a permanent locked position or in a removable secured position depending upon the intent of the user. The tool can be any of the implements shown in the preceding figures, including a razor attachment, a scraper, a blade, a brush, massager, a sponge applicator, a sandpaper/polishing pad, and the like. The tool can be received by the attachment unit 210 by securing the male extension 264 of the tool implement 262 into the female receptacle 266 of the attachment unit 210. The working end of the implement can be a razor attachment, a blade, a cosmetic scraper, a brush, massager, sandpaper/polishing pad, and the like.

As discussed above, the razor blade attachment plate is offset 25 degrees plus/minus 5 degrees to the longitudinal axis of the flexible tube (FIGS. 10-11). The cosmetic scraper is offset 30-90 degrees with respect to the main plane MP of the attachment unit and/or the longitudinal axis LA of the flexible tube. The sealed end of the tube is planar and lies in or is parallel to the longitudinal axis of the flexible tube. The planar backside 22 of the frame 12 is normally parallel to or intersected by the longitudinal axis of the flexible tube since the planar backside is secured to the sealed end. The planar scraper blade and the planar grouting blade FIGS. 20-22 are roughly parallel with respect to the main plane MP of the attachment unit 10C and/or intersects or is parallel to the longitudinal axis LA of the flexible tube. Although the planar blade tool is normally planar with respect to the longitudinal axis of the flexible tube, the blade can be offset from the longitudinal axis LA, such as angled out 45 degrees if so desired. The support plates for the attachment units 10D, 10F, 10G, and 10H are normally offset around 45 degrees plus/minus 15 degrees from the main plane MP and/or longitudinal axis LA. That is, a perpendicular axis PA passing through the support plate (see FIG. 25) is 45 degrees to the longitudinal axis LA of the flexible tube and/or the main plane MP of the frame plus/minus 15 degrees. However, the support plate can be perpendicular to the longitudinal axis LA of the flexible tube or the main plane MP of the frame depending upon the tool and how it is most effectively used.

As discussed above, the attachment units can be fixed to, or secured to, the sealed end of the flexible tube with welding (heat or sonic) forming a weldment boundary between the sealed end and the attachment unit, or with an adhesive or cement capable of bonding the attachment unit to the sealed end forming an adhesive or bonding film or layer between the sealed end and the attachment unit, or by a fasteners such as a rivet.

One of ordinary skill in the art would appreciate that embodiments of the present invention include squeezable tubes having devices attached to the sealed end of the squeezable tube. The devices include plastic injection molded or blow molded components that clip on to, are glued to, are welded on, and/or are pressure fitted to the sealed end of the tube. These attached tools can be molded as a finished tool or a universal flat panel or socket where the tool attaches directly onto the neck. The tool that is attached to the tube or these "tools" can be "plugged" into the tool for the desired use. The "plug-in" can be a snap on, snap in, glued on, or screwed on to the neck of the tube tool. The tube tool neck is the component that attaches to the sealed end of the tube. The tool is the component that is molded along with the neck as one piece or attached onto the neck or removably attached to a fixedly connected neck. The diameter of the sealed extruded tubes range from a 12 mm diameter tube up to a 70 mm diameter tube. Diameter is the pre-seal round diameter.

A further delineation of the embodiments of the present invention are provided below. In particular, these embodiments are directed toward novel structures for removably attaching a tube tool, plus frame, to a conventional tube. These embodiments also include a novel structure for removably securing an applicator head to a tube.

A fixed tube tool neck accommodates a useful device that can be removably attached to the neck and is specific to the liquid contained in the tube. Preferred applications include caulking, scrapers, scrubbing brushes, and cosmetic applicators. Preferred manufacturing techniques include plastic injection molding, blow molded, or metal forging or forming. Preferred size parameters are from 2 mm to 100 mm in width. FIGS. 48 to 50 and 54 to 60 provide exemplary embodiments of the present invention, including different neck structures and different applicator heads. Such devices can be injection molded or blow molded (2-shot injection molding with polyethylene plus silicone rubber). The two shot manufacturing process allows for a flexible neck with varying degrees of flexibility.

Performance characteristics are preferably defined by referencing flex factors at the base of the neck, middle of the neck, and the point of tool attachment. For a dual material part, the bendable neck flex factor will have unique range. For example, the flex factor can be 5 mm to 100 mm (neck can be vertical, angled, arc, converse, convex, or bent). The neck accommodates the tool through any combination of screw-in, plug in, snap on, slip on, flat panel, socket, magnetic, or hook and loop attachment means.

Figure 54B:
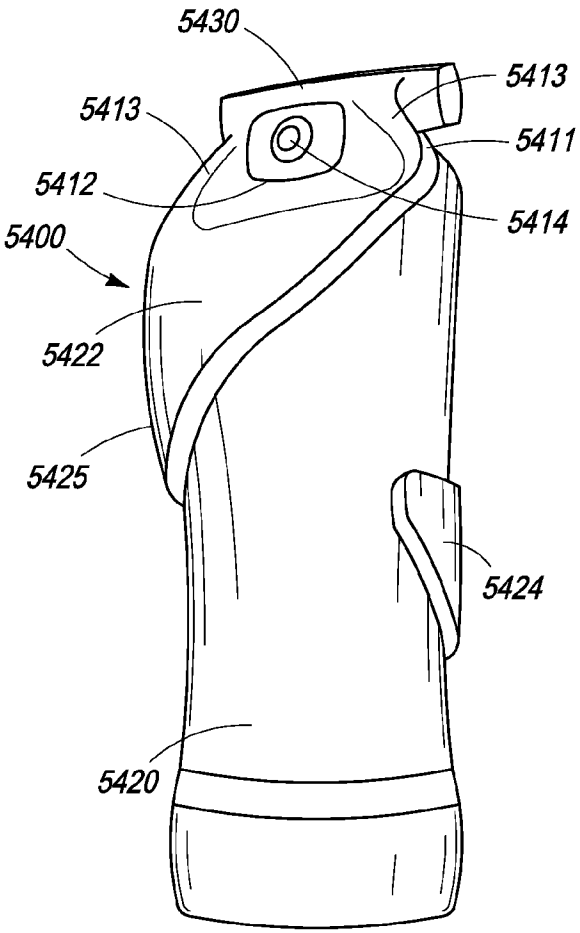
FIG. 54*b* shows a back side perspective view, respectively, of an embodiment of the tube tool body structure of the present invention that has a helical arm.
Figure 54A:
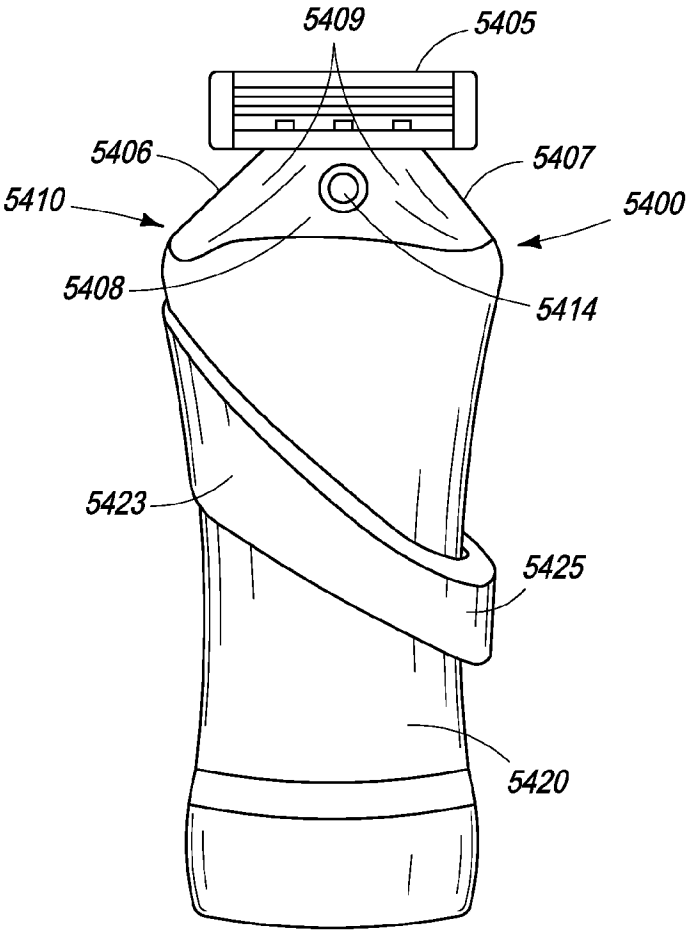
FIG. 54*a* shows a front side perspective view, respectively, of an embodiment of the tube tool body structure of the present invention that has a helical arm.

FIGS. 54*a* and 54*b* show front and back side perspective views, respectively, of one embodiment of the tube tool body structure 5400 of the present invention that accommodates or supports a removably attachable tool or plug-in device 5405. In one embodiment the tool device 5405 is a razor. The tube tool body 5400 comprises a front-end frame 5410 and a back-end frame 5411. In one embodiment, the structure 5400 is snapped onto the sealed end of a semi-rigid or flexible tube 5420 such that the end-seal of the semi-rigid 5420 is tightly accommodated or press/pinch fitted between the front-end and back-end frames 5410, 5411. The front-end frame 5410 has a pair of U-shaped ribs 5406 and 5407 that form the left and right side, respectively, of the frame 5410. The ribs 5406, 5407 join at the top to form a neck 5430 culminating into a platform for supporting the tool device 5405, such as razor plate, thereto. While in one embodiment, the tool device 5405 is formed as an integral part of the structure 5400 in an alternate embodiment the tool device is removably attached to the platform through any combination of screw-in, plug in, snap on, slip on, flat panel, socket, magnetic, or using hook and loop attachment means.

The ribs 5406, 5407 also define a substantially triangular portion 5408 therebetween. Recesses or depressions 5409 of the ribs provide an aesthetic sense while allowing for less overall material usage in forming the structure 5400. While the triangular portion 5408 is a raised portion at the front-end frame 5410, with respect to rib recesses 5409, its opposite counter-portion 5412 at the back-end frame 5411 is depressed. Similarly, the rib depressions 5409 at the front-end frame 5410 have counter-portions 5413 at the back-end frame 5411 that are raised with respect to the depressed portion 5412. The aforementioned combination of raised and depressed counter portions at the front and back-end frames ensure proper rigidity to the structure 5400 while allowing an overall saving in the material used to form the structure 5400.

The back-end frame 5411 also has a downwardly extending helical arm 5425. The helical arm 5425 has a substantially triangular portion 5422 as an extension of the back-end frame 5411. Portion 5422 while extending further downwards wraps around one side of the tube 5420 to helically emerge as a front-end support portion 5423 that further wraps around the other side to extend in the form of a tail-end portion 5424 at the back-end. The helical arm 5425 adds additional support and rigidity to the tool structure 5400 as it clings on to a substantial portion of the flexible tube 5420 in the form of a helix.

A hole 5414 extends through the frame from the front-end 5410 to the back-end 5411, in registration with a similar hole at the end-seal 5415, and is adapted to receive a hanger to support the tool body structure 5400 during display at retail outlets/showrooms. In one embodiment, structure 5400 is alternatively or additionally secured to end-seal of semi-rigid tube 5420 by sonic welding, heat welding, plasma welding an adhesive, or by a rivet passing through the hole 5414.

Figure 55B:
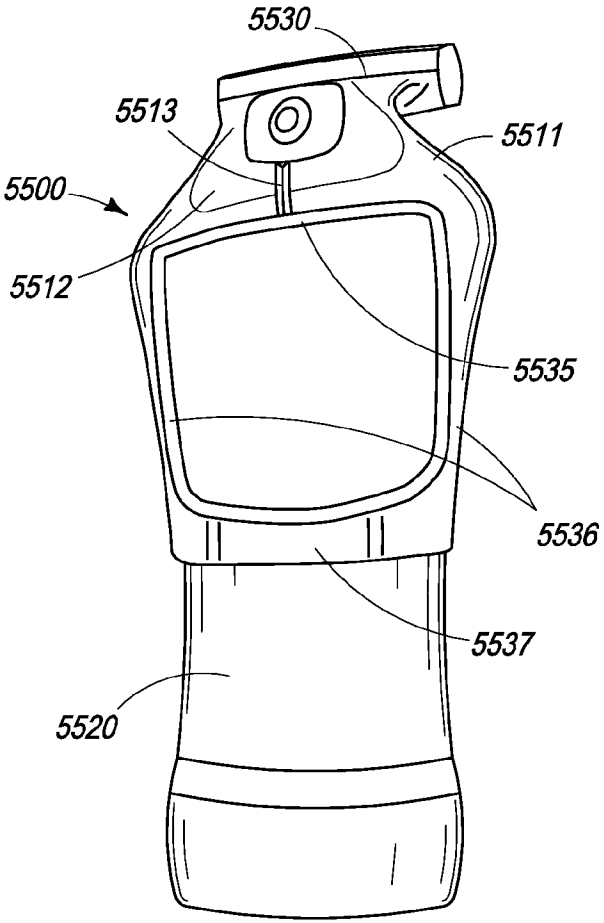
FIG. 55*b* shows a back side perspective view, respectively, of another embodiment of the tube tool body structure of the present invention where outer ends of the base, at the front and back-end frames, extend downwards to form two vertical sides which join at the bottom to form a horizontal rib.
Figure 55A:
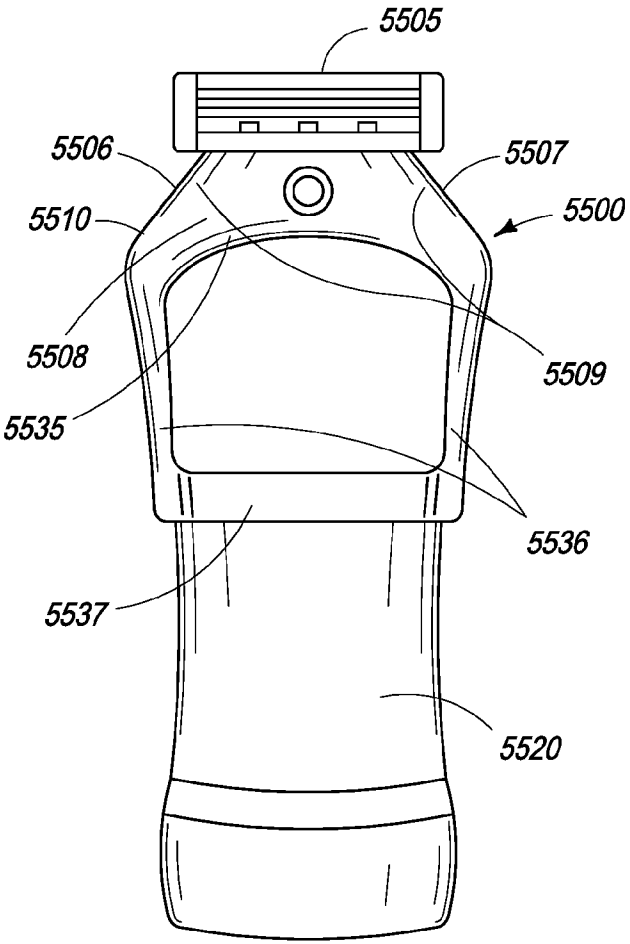
FIG. 55*a* shows a front side perspective view, respectively, of another embodiment of the tube tool body structure of the present invention where outer ends of the base, at the front and back-end frames, extend downwards to form two vertical sides which join at the bottom to form a horizontal rib.

FIGS. 55*a* and 55*b* show front and back side perspective views, respectively, of another embodiment of the tube tool body structure 5500 of the present invention that accommodates or supports a removably attachable tool or plug-in device 5505. In one embodiment the tool device 5505 is a razor. The tube tool body 5500 comprises a front-end frame 5510 and a back-end frame 5511. In one embodiment, the structure 5500 is snapped onto the sealed end of a semi-rigid or flexible tube 5520 such that the end-seal of the semi-rigid 5520 is tightly accommodated or press/pinch fitted between the front-end and back-end frames 5510, 5511. The front-end frame 5510 has a pair of U-shaped ribs 5506 and 5507 that form the left and right sides, respectively, of the frame 5510. The ribs 5506, 5507 join at the top to form a neck 5530 culminating into a platform for supporting the tool device 5505, such as razor plate, thereto. While in one embodiment, the tool device 5505 is formed as an integral part of the structure 5500 in an alternate embodiment the tool device is removably attached to the platform through any combination of screw-in, plug in, snap on, slip on, flat panel, socket, magnetic, or hook and loop attachment means.

The ribs 5506, 5507 also define a substantially triangular portion 5508 therebetween. Recesses or depressions 5509 of the ribs provide an aesthetic sense while allowing for less overall material usage in forming the structure 5500. The back-end frame 5511 forms a planar wall 5512 replicating the shape of the front-end frame 5510 albeit without the rib depressions 5509. Instead, a longitudinal recess 5513 runs through the middle and serves to indicate an alignment with the longitudinal axis of the tube 5520. In one embodiment the outer ends of the base 5535, at the front and back-end frames 5510 and 5511, extend downwards to form two vertical sides 5536 which join at the bottom to form a horizontal rib 5537. Persons of ordinary skill in the art should appreciate that the vertical sides 5536 cover and overlap the respective side-edges of the tube 5520 while the horizontal rib 5537 acts as a bottom support for both the front-end and back-end frames 5510, 5511. The base 5535, vertical sides 5536 and horizontal rib 5537 together form a frame that covers a substantial portion of the tube 5520 and thereby provides additional rigidity and support to the structure 5500.

Figure 56B:
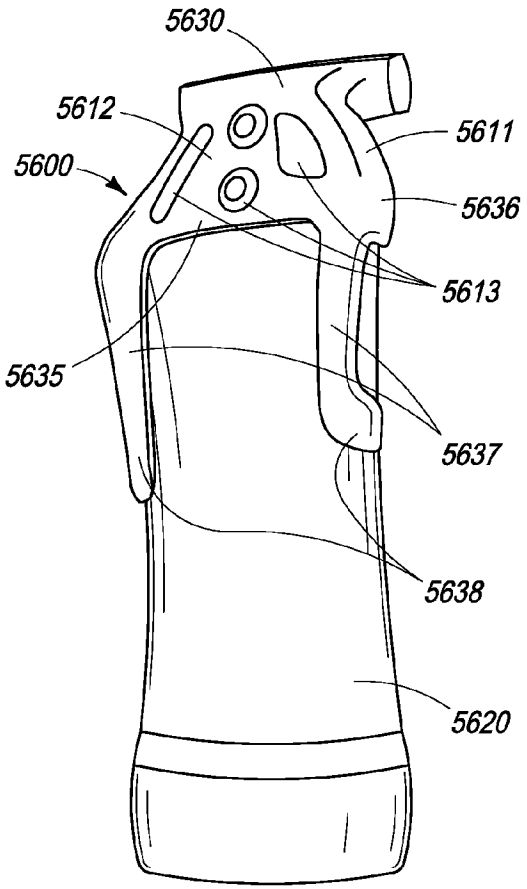
FIG. 56*b* shows a back side perspective view, respectively, of another embodiment of the tube tool body structure of the present invention where the outer ends of the base, at the front and back-end frames, extend downwards to form two short vertical sides that cover or overlap the respective side-edges of the tube over a short length such that the two vertical sides angle towards each other shortly to then extend further down to form longer vertical frames.
Figure 56A:
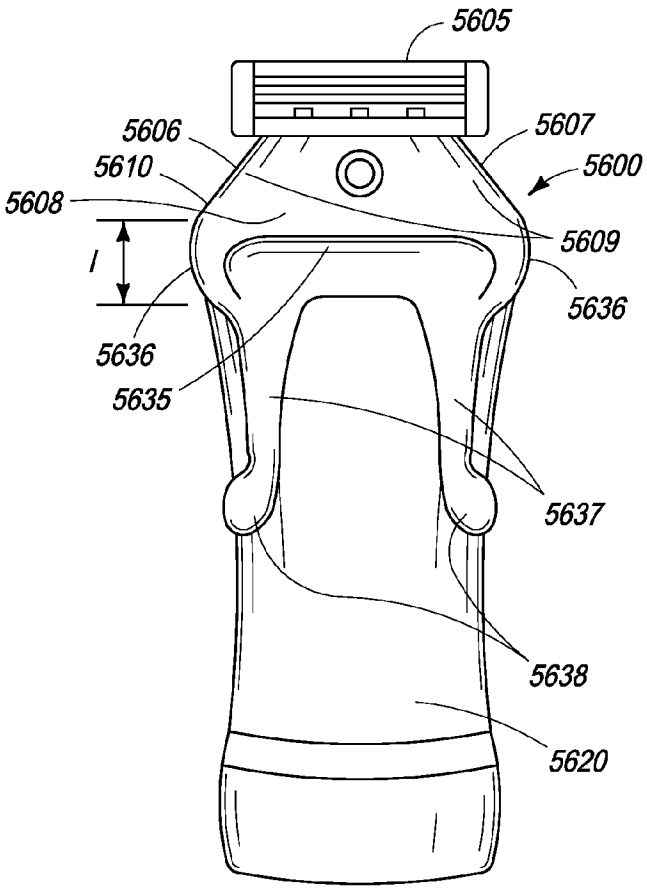
FIG. 56*a* shows a front side perspective view, respectively, of another embodiment of the tube tool body structure of the present invention where the outer ends of the base, at the front and back-end frames, extend downwards to form two short vertical sides that cover or overlap the respective side-edges of the tube over a short length such that the two vertical sides angle towards each other shortly to then extend further down to form longer vertical frames.

FIGS. 56*a* and 56*b* show front and back side perspective views, respectively, of another embodiment of the tube tool body structure 5600 of the present invention that accommodates or supports a removably attachable tool or plug-in device 5605. In one embodiment the tool device 5605 is a razor. The tube tool body 5600 comprises a front-end frame 5610 and a back-end frame 5611. In one embodiment, the structure 5600 is snapped onto the sealed end of a semi-rigid or flexible tube 5620 such that the end-seal of the semi-rigid 5620 is tightly accommodated or press/pinch fitted between the front-end and back-end frames 5610, 5611. The front-end frame 5610 has a pair of U-shaped ribs 5606 and 5607 that form the left and right sides, respectively, of the frame 5610. The ribs 5606, 5607 join at the top to form a neck 5630 culminating into a platform for supporting the tool device 5605, such as razor plate, thereto. While in one embodiment, the tool device 5605 is formed as an integral part of the structure 5600 in an alternate embodiment the tool device is removably attached to the platform through any combination of screw-in, plug in, snap on, slip on, flat panel, socket, magnetic, or hook and loop attachment means.

The ribs 5606, 5607 also define a substantially triangular portion 5608 therebetween. Recesses or depressions 5609 of the ribs provide an aesthetic sense while allowing for less overall material usage in forming the structure 5600. The back-end frame 5611 forms a wall 5612 replicating the shape of the front-end frame 5610 albeit without the rib depressions 5609. Instead, a plurality of contoured depressions 5613 are formed on the wall 5612. In one embodiment the outer ends of the base 5635, at the front and back-end frames 5610 and 5611, extend downwards to form two short vertical sides 5636 that cover or overlap the respective side-edges of the tube 5620 over a short length 'l'. Thereafter, the two vertical sides 5636 angle towards each other shortly to then extend further down to form longer vertical frames 5637. The vertical frames 5637, at the front-end frame 5610 and bottom-end frame 5611, join each other in the form of curved portions 5638 over the respective side-edges of the tube 5620. The base 5635, short vertical sides 5636, longer vertical frames 5637 and curved portions 5638 together form a frame that covers a substantial portion of the tube 5620 and thereby provides additional rigidity and support to the structure 5600.

Figure 57:
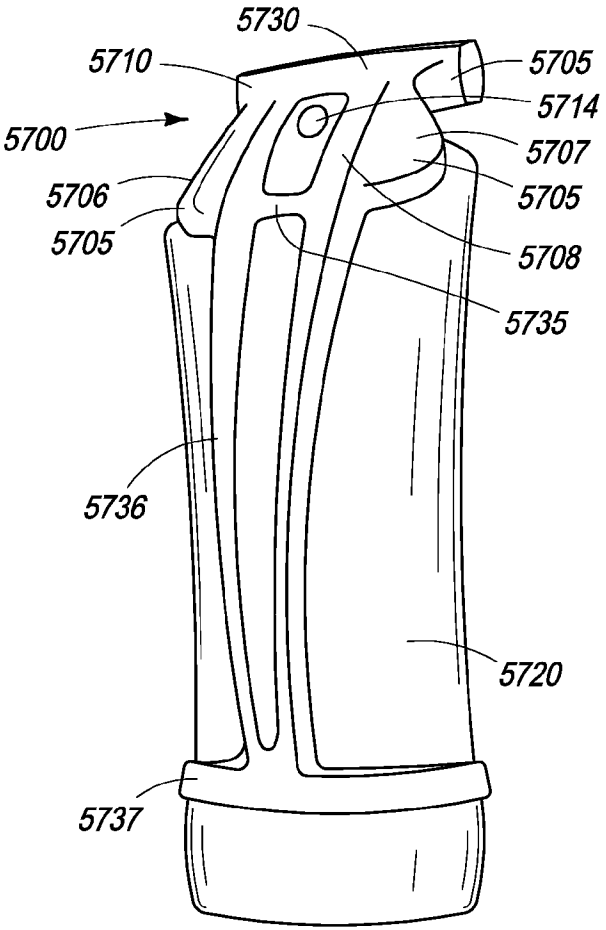
FIG. 57 shows a front-side perspective view of another embodiment of the tube tool body structure of the present invention.

FIG. 57 shows a front-side perspective view of another embodiment of the tube tool body structure 5700 of the present invention that accommodates or supports a removably attachable tool or plug-in device 5705. The front side of frame 5710 has a pair of U-shaped ribs 5706 and 5707 that form the left and right sides, respectively, of the frame 5710. The ribs 5706, 5707 join at the top to form a neck 5730 culminating into a platform for supporting the tool device 5705, such as razor plate, thereto. While in one embodiment, the tool device 5705 is formed as an integral part of the structure 5700 in an alternate embodiment the tool device is removably attached to the platform through any combination of screw-in, plug in, snap on, slip on, flat panel, socket, magnetic, or hook and loop attachment means.

A plurality of horizontal depressions or contours 5709 are formed within the U-shaped ribs 5706, 5707. The ribs 5706, 5707 also define a substantially rectangular portion 5708 therebetween. The base 5735 (of the rectangular portion 5708) extends downwards in the form of a spine 5736 that culminates into a circular or semi-circular cap 5737 that surrounds the tube 5720 at the bottom, proximate the open-end of the tube. The front side ribs 5706 and 5707, the spine 5736 and the circular cap 5737 together form an integrated structure 5700 which is strong and yet light weight and minimizes the use of materials while being rigid enough to allow a desired function. The spine 5736 also has a longitudinal recess that allows for less material usage without compromising the overall sturdiness/support.

The back side of the frame 5710 is in the form of a planar wall (not visible in FIG. 57). In one embodiment, the surface of the back side is cut inwardly to form an arcuate scalloped wall to receive the bulging wall of the semi-rigid tube 5720. A hole 5714 extends through the frame from the ribbed front side 5710 to the planar back side, in registration with a similar hole at the end seal, adapted to receive a hanger to support the structure 5700 or a fastener, such as a rivet, to secure the structure 5700 to the sealed end of the flexible tube 5720.

Figure 58:
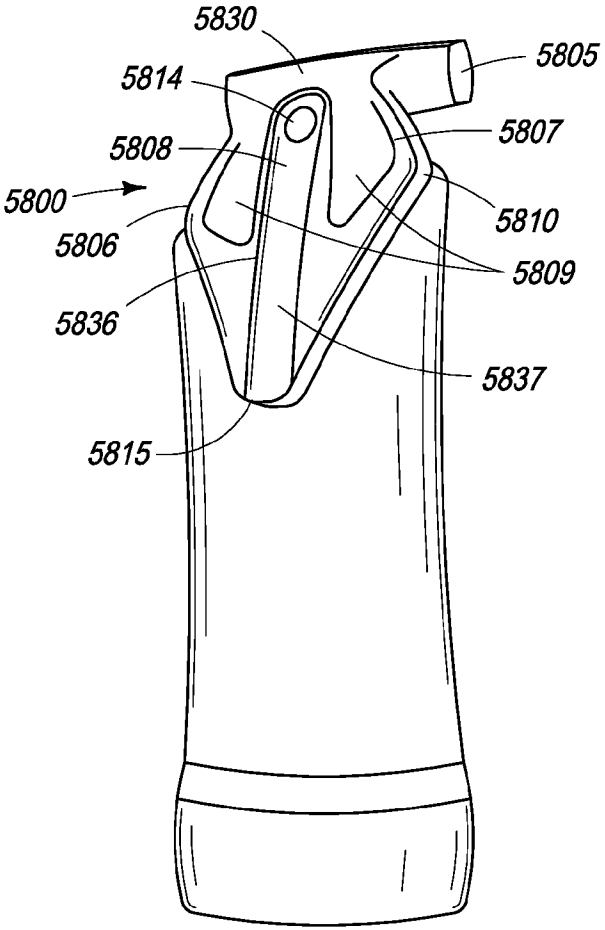
FIG. 58 shows a front-side perspective view of another embodiment of the tube tool body structure of the present invention.

FIG. 58 shows a front-side perspective view of another embodiment of the tube tool body structure 5800 of the present invention that accommodates or supports a removably attachable tool or plug-in device 5805. The front side frame 5810 has a pair of substantially U-shaped ribs 5806 and 5807 that form the left and right sides, respectively, of the frame 5810. The ribs 5806, 5807 join at the top to form a neck 5830 culminating into a platform for supporting the tool device 5805, such as razor plate, thereto. While in one embodiment, the tool device 5805 is formed as an integral part of the structure 5800 in an alternate embodiment the tool device is removably attached to the platform through any combination of screw-in, plug in, snap on, slip on, flat panel, socket, magnetic, or hook and loop attachment means.

Depressions or recesses 5809 are formed within the U-shaped ribs 5806, 5807. The ribs 5806, 5807 also define a portion 5808 therebetween. The base of the portion 5808 extends downwards in the form of a short spine 5836. The sides of the portion 5808 also extend downwards to join at the farther end 5815 of the spine 5836. A recess 5837 runs along the spine 5836. The front side ribs 5806 and 5807 and the short spine 5836 form an integrated structure 5800 which is strong and yet light weight. The recesses 5809, 5837 minimize use of materials without compromising the overall sturdiness of the structure 5800.

The back side of the frame 5810 is in the form of a planar wall (not visible in FIG. 58). In one embodiment, the surface of the back side is cut inwardly to form an arcuate scalloped wall to receive the bulging wall of the semi-rigid tube 5820. A hole 5814 extends through the frame from the front side 5810 to the planar back side adapted to receive a hanger to support the structure 5800 or a fastener, such as a rivet, to secure the structure 5800 to the sealed end of the flexible tube 5820.

Figure 59:
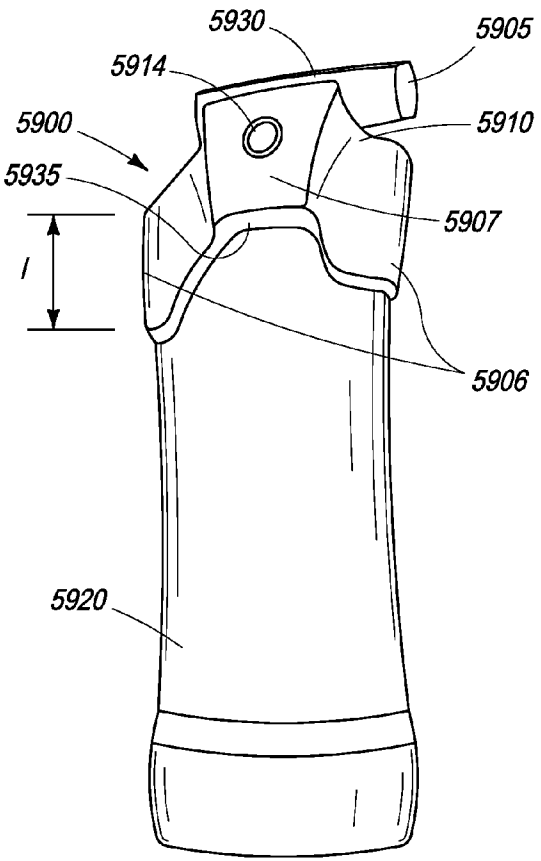
FIG. 59 shows a front-side perspective view of yet another embodiment of the tube tool body structure of the present invention.

FIG. 59 shows a front-side perspective view of yet another embodiment of the tube tool body structure 5900 of the present invention that accommodates or supports a removably attachable tool or plug-in device 5905. The frame 5910 has a pair of vertically extending shoulders 5906 that form the left and right sides, respectively, of the frame 5910. The shoulders 5906 overlap or cover the respective sides of the tube 5920 over a limited length 'l'. The shoulders 5906 define a substantially triangular portion 5907 that in one embodiment is raised with respect to the shoulders 5906. The shoulders 5906 coalesce with the portion 5907 at the top to form a neck 5930 culminating into a platform for supporting the tool device 5905, such as razor plate, thereto. While in one embodiment, the tool device 5905 is formed as an integral part of the structure 5900 in an alternate embodiment the tool device is removably attached to the platform through any combination of screw-in, plug in, snap on, slip on, flat panel, socket, magnetic, or hook and loop attachment means. In one embodiment the base 5935 of the triangular portion 5907 is arched upwards as it fuses with the inner edges of the shoulders 5906.

The back side of the frame 5910 is in the form of a planar wall (not visible in FIG. 59). In one embodiment, the surface of the back side is cut inwardly to form an arcuate scalloped wall to receive the bulging wall of the semi-rigid tube 5920. A hole 5914 extends through the frame from the front side 5910 to the planar back side adapted to receive a hanger to support the structure 5900 or a fastener, such as a rivet, to secure the structure 5900 to the sealed end of the flexible tube 5920.

Figure 60:
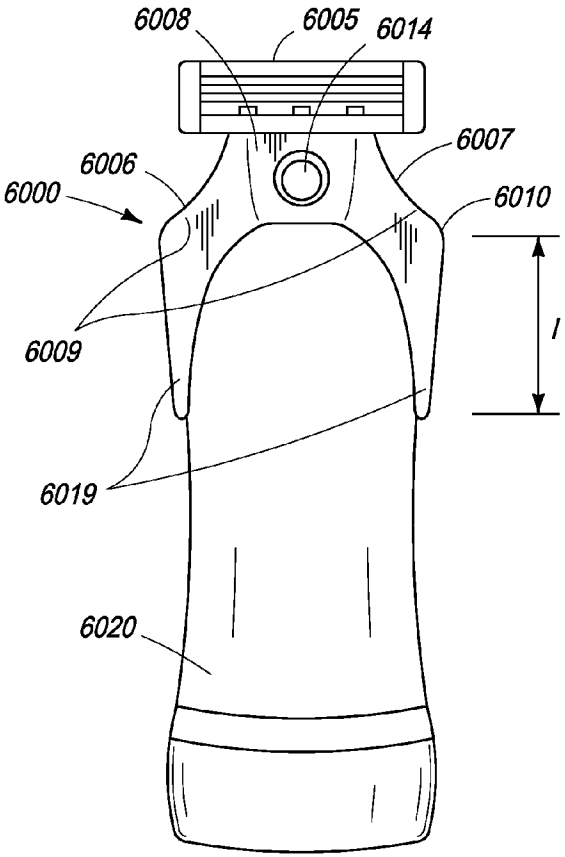
FIG. 60 shows a perspective view of still another embodiment of the tube tool body structure of the present invention.

FIG. 60 shows a perspective view of still another embodiment of the tube tool body structure 6000 of the present invention that accommodates or supports a removably attachable tool or plug-in device 6005. The frame 6010 has a pair of substantially U-shaped ribs 6006 and 6007 that form the left and right sides, respectively, of the frame 6010. The ribs 6006, 6007 join at the top to form a neck culminating into a platform for supporting the tool device 6005, such as razor plate, thereto. While in one embodiment, the tool device 6005 is formed as an integral part of the structure 6000 in an alternate embodiment the tool device is removably attached to the platform through any combination of screw-in, plug in, snap on, slip on, flat panel, socket, magnetic, or hook and loop attachment means.

Depressions or recesses 6009 are formed within the U-shaped ribs 6006, 6007. The ribs 6006, 6007 extend downwards in the form of shoulders 6019 to overlap or cover the respective side-edges of the tube 6020 over a limited length 'l'. The ribs 6006, 6007 also define a portion 6008 therebetween that is depressed with respect to the ribs 6006, 6007. The base of the portion 6008 is arched upwards and fuses with the inner edges of the shoulders 6019.

The back side of the frame 6010 is in the form of a planar wall (not visible in FIG. 60). In one embodiment, the surface of the back side is cut inwardly to form an arcuate scalloped wall to receive the bulging wall of the semi-rigid tube 6020. A hole 6014 extends through the frame from the front side 6010 to the planar back side adapted to receive a hanger to support the structure 6000 or a fastener, such as a rivet, to secure the structure 6000 to the sealed end of the flexible tube 6020.

In the aforementioned embodiments, the tube tool body structures of FIGS. 54 through 60 are attached to the sealed-end of the flexible tube while the other end is a regular tube opening.

A tube "plug-In" includes any structure that can be attached such as a disposable razor, comb, brush, or scraper. It can be made using plastic, metal, ceramic, foam or glass. Structurally, the device has a flat panel in the shape of round, square, diamond, rectangular panel or shallow sockets with a depth from 0 mm to 15 mm in depth. In one embodiment, the flat panel has a 5 mm diameter to 80 mm×80 mm round, oval, square, rectangular, or any additional shape between the two. The flat panel may accommodate an additional flared-out or larger applicator ranging from 5 mm diameter or 5 mm square up to 200 mm diameter or 200 mm square. An accommodating socket may be used that ranges from a depth of 0.1 mm to 30 mm depth. The flat panel is used to accommodate additional applicators by liquid adhesive attachment, hook and loop materials, clip in, clip on, or pressure fit materials. The panel may be surrounded by an addition vertical lip that forms a socket to accommodate the applicator material. The socket may surround the entire panel or in sections. The device may be manufactured using an injection molding, blow molding, or metal forging or forming. Performance characteristics are preferably defined by referencing flex factors at the base of the neck, middle of the neck, and the point of tool attachment. For a dual material part, the bendable neck flex factor will have unique range.

A comb-tool attachment can be made using plastic, metal, ceramic, rubber or low to high density polyethylene. Structurally, the device comprises a bristles or single row or multi row tooth configuration in the range of 5 mm width to 240 mm with teeth having 1 mm diameters to 5 mm round or rectangular teeth from 0.5 mm width to 5 mm width to 0.5 mm to 50 mm depth. The bristles can be straight up and down, arc, angled or with a thickness diameter in the range of 0.25 mm to 3 mm. The device may be manufactured using an injection molding, blow molding, or metal forging or forming. Performance characteristics are preferably defined by referencing flex factors at the base of the neck, middle of the neck, and the point of tool attachment, bristle collapse, bristles per linear inch, and the number of teeth rows.

A brush-tool attachment can be made using plastic, metal, ceramic, rubber or low to high density polyethylene. Structurally, the device comprises brush bristles can be configured in the form of oval, round, square, rectangle, diamond, bone, bean, or star shapes. The bristle diameters and lengths can range from 0.01 mm diameter to 6 mm diameter. The base width can be in the range of 20 mm to 140 mm, base depth can be in the range of 20 mm to 140 mm, and the bristles thickness diameter can be in the range of 0.25 mm to 3 mm. The device may be manufactured using an injection molding, blow molding, or metal forging or forming. Bristle installation can be performed manually or automatically. The bristles can be straight up and down, arc, or angled. Performance characteristics are preferably defined by referencing flex factors at the base of the neck, middle of the neck, and the point of tool attachment, bristle collapse, bristles per linear inch, and the number of teeth rows.

A scraper-tool attachment that can be made using plastic, metal, ceramic, polyurethane, acrylic, HDPE, or LDPE. Structurally, the scraper can be straight, concave, convex, pointed, right triangle, thick, blunt, straight with a tapered beveled razor sharp edge, saw tooth, or notched. The scraper blade can range in size from a fine point <0.1 mm to 200 mm in width and <0.1 mm in depth to 10 mm blade depth. The device may be manufactured using an injection molding, blow molding, or metal forging or forming, or 2-shot injection molding. Performance characteristics are preferably defined by referencing flex factors at the base of the neck, middle of the neck, and the point of tool attachment.

A soft-applicator tool attachment can be made using soft compressible materials similar to foam and sponge, with materials formed in several densities, durability, and hardness to achieve use effect, such as EVA or cross linked poly ethylene. Structurally, the soft-applicator tool may comprise molded shapes or die cut shapes in the form of ovals, round shapes, squares, rectangles, diamonds, bone shapes, bean shapes, or star shapes. The tool can range in thickness from 2 mm to 20 mm, width from 2 mm to 100 mm, depth from 2 mm to 100 mm. The device may be manufactured using standard methods of foam and sponge production (air mixed with liquid polymers). Structurally, the soft applicator can be a closed cell, open cell, combinations of closed or open cells, combinations of differently sized closed and open cells, or any of the aforementioned structures with a top layer. Performance characteristics are preferably defined by durometer, density, absorbency, elongation to break, buoyancy, and compression.

In one embodiment, the soft-applicator tool is supported on any of the tube tool body structures described in FIGS. 55 to 58, such that the applicator tool is at the sealed end of the flexible tube while the other end of the tube is open. In an alternate embodiment, the soft-applicator tool is supported at the open end of the flexible tube while the sealed-end of the tube may or may not comprise a tube tool body structure.

Figure 49:
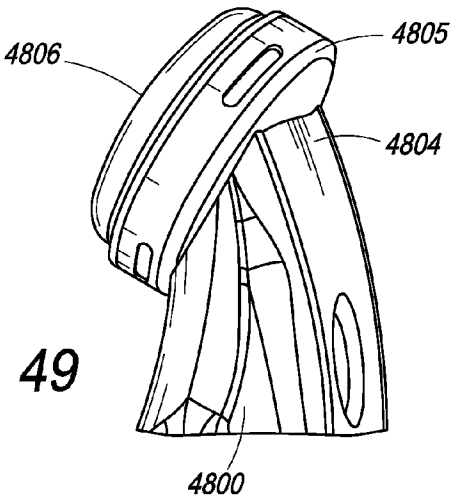
FIG. 49 is another perspective view of an embodiment where a soft-applicator tool attachment or head is supported on a tube tool body structure.
Figure 50:
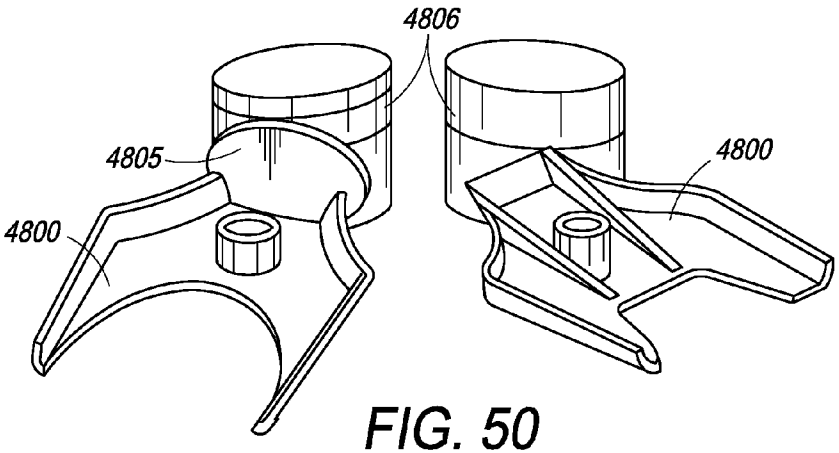
FIG. 50 is another perspective view of an embodiment where a soft-applicator tool attachment or head is integrated into a two-part frame.
Figure 48:
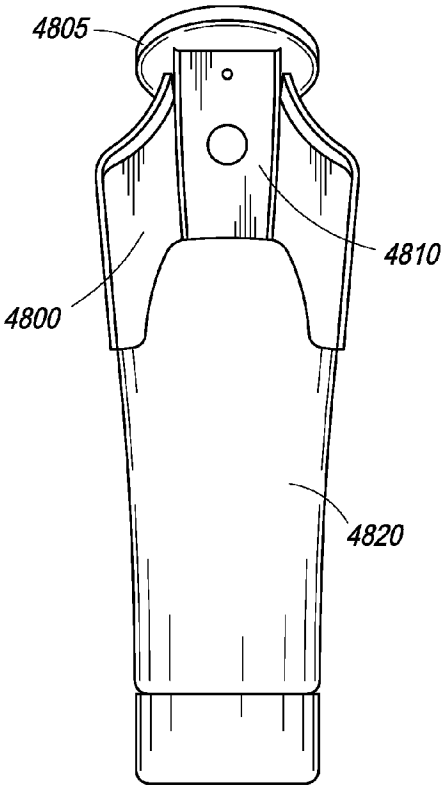
FIG. 48 is a perspective view of an embodiment where a soft-applicator tool attachment or head is supported on a tube tool body structure.

FIGS. 48 through 50 are perspective views of an embodiment where a soft-applicator tool attachment or head 05 is supported on a tube tool body structure 4800 (similar to the one described with reference to FIG. 60 and which in that embodiment supported a razor as the tool device). In this embodiment, the tool body structure 4800 is attached to the end-seal 4810 of flexible, squeezable tube 4820. The neck 4804 culminates in the form of applicator tool/head 4805 that in one embodiment is a round shaped platform. A soft applicator 4806 such as that of foam or sponge (or any other soft material as described earlier in the specification) is supported by the applicator tool/head 4805. In one embodiment, the soft applicator 4806 is attached to the applicator head 4805 using protrusions or barbs that protrude outwards from the applicator head 4805 These protrusions or barbs are manufactured into and integral to the applicator head 4805 in one embodiment. In an alternate embodiment, the barbs are formed into a separate ring that is then snapped into place on the applicator head 4805. Also, the barbs are preferably curved so that they project into the applicator 4806.

While the barbs can be of any number, length, width and angle, in one preferred embodiment with an oval 38 mm tube opening, these are numbered in the range of 1 to 100, have lengths in the range of 1 mm to 4 mm, have widths in the range of 0.5 mm to 3 mm and are angled in the range of 45 degrees upwards to 45 degrees downward, relative to the surface of the tube socket side wall. Persons of ordinary skill in the art should note that the optimal combination of number, length, width and angle of the barbs is dependent on the kind/characteristics of soft applicator 4806 being used. For example, if the applicator 4806 is foam that is of the mini-cell type and therefore firm then more number of barbs is used while being smaller and shorter. However, if the foam is more flexible and porous then longer and sharper barbs are used. In an alternate embodiment, the soft-applicator tool attachment or head 4805 is attached to the open end of the tube 4820 while the sealed-end of the tube has no attachments.

Figure 62:
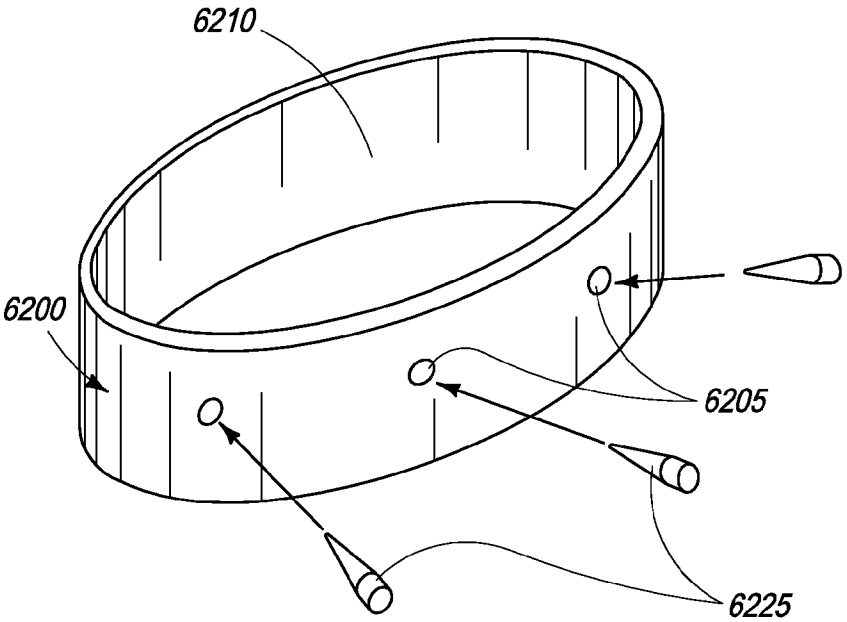
FIG. 62 shows a side view of a tube opening with barbs inserted into a plurality of holes.

These barbs and tube opening may be manufactured within a primary mold as a one piece construction. Alternatively, the tube opening may be pre-manufactured with a plurality of holes in the socket defining the opening of the tube and the barbs may be added as secondary parts where the barbs, akin to nails, are inserted through holes positioned around the socket walls and pushed into the applicator and locked into place. Referring to FIG. 62, the tube opening 6200 having a central space 6210 comprises a plurality of holes or voids 6205 through which protrusions, e.g. barbs, 6225 can be inserted. The protrusions 6225 function to capture, trap, and hold in place a foam substrate.

Figure 61:
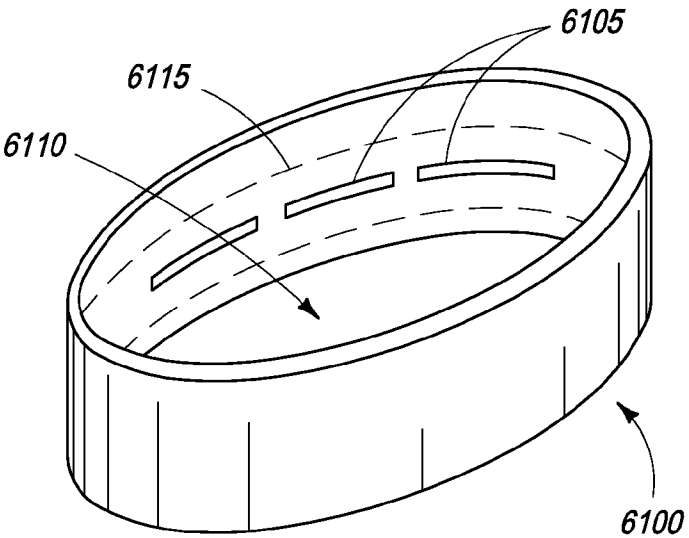
FIG. 61 shows a side view of a tube opening having a ring with elongated protrusions.

The tube opening may also be pre-manufactured with a space to receive a ring, which can be snapped in place, wherein the ring is constructed from a single mold with a plurality of barbs or elongated protrusions (e.g. ridges, elevated edges, extensions, shelves). When the ring is snapped into the socket, the elongated protusions extend into the tube opening to hold the foam in place. Referring to FIG. 61, the tube opening 6100 having a central space 6110 comprises a ring 6115 that has been snapped into place. The ring 6115 further comprises a plurality of elongated protrusions 6105 for capturing, trapping, and holding in place a foam substrate.

Figure 52:
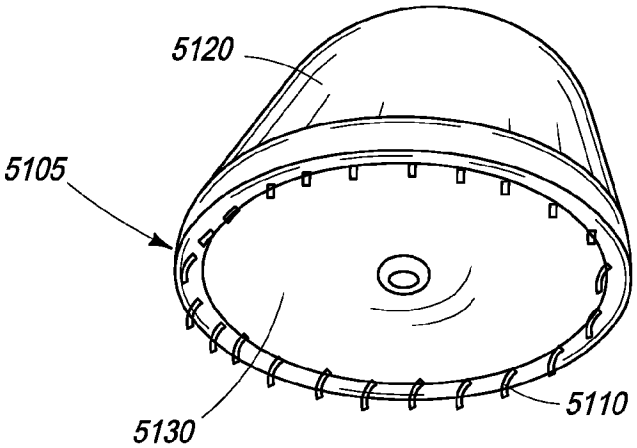
FIG. 52 shows another embodiment where a soft applicator is supported at the open end of semi-rigid or flexible tube by the use of curved barbs or protrusions.
Figure 51:
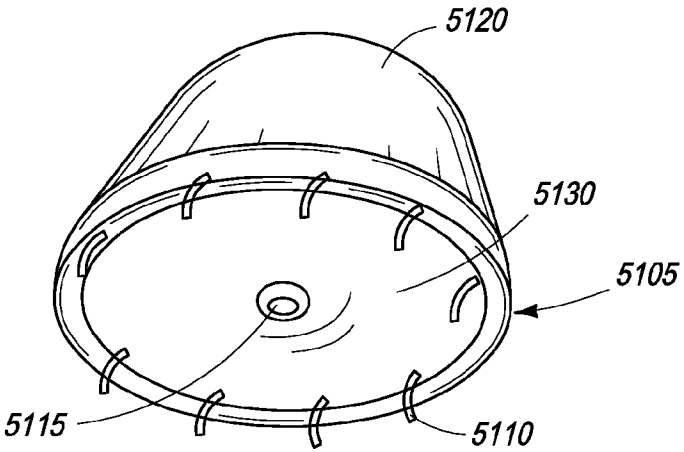
FIG. 51 shows an embodiment where a soft applicator is supported at the open end of semi-rigid or flexible tube by the use of curved barbs or protrusions.
Figure 53:
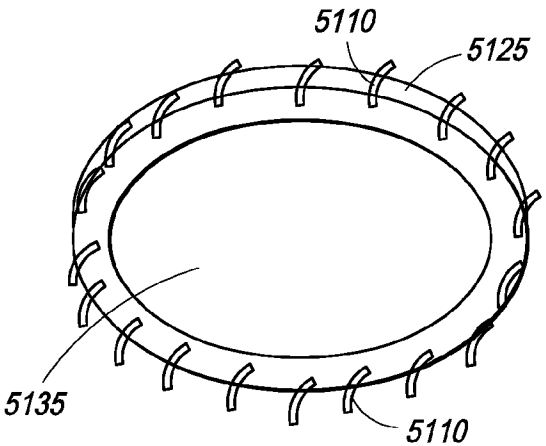
FIG. 53 shows another embodiment where barbs are formed on a separate/standalone applicator head or ring-shaped platform.

FIGS. 51 to 52 show another embodiment where a soft applicator is supported at the open end 5105 of semi-rigid or flexible tube 5120 by the use of curved barbs or protrusions 5110. The barbs 5110 are manufactured integral to the open end 5105 around the opening/nozzle 5115. FIG. 51 shows an embodiment where the barbs 5110 are fewer in number and longer while FIG. 52 shows another embodiment where the barbs 5110 are shorter and more numerous—in each case formed only along the inside edges of the circumference of the open end 5105 of the tube 5120. In a yet another embodiment, as shown in FIG. 53, the barbs 5110 are formed on a separate/standalone applicator head or ring-shaped platform 5125 which can be either snapped-on over the circumference of the open end 5105 or in another embodiment is press fitted into the hollowed/scalloped region 5130 of the open end 5105. The barbed ring 5125 also comprises opening 5135 that align with a tube nozzle when the ring 5125 is placed at the open end of a tube. In one embodiment the barbs 5110 are curved, however, in alternate embodiments these are straight. Soft applicators, such as those described with reference to FIG. 48 through 50, are supported using the barbs 5110 of FIGS. 51 through 53.

Referring back to FIGS. 48 to 50, in another embodiment the sealed-end of the tube 4820 removably supports the tube tool body structures of FIGS. 54 through 60 while the open-end of the tube supports the soft-applicator head 4805.

The present invention contemplates a number of combinations of use of the tool body structures of FIGS. 54 through 60 and the soft-applicator of FIGS. 48 through 53. In one embodiment the tool body structure of FIGS. 54 through 60 is detachably attached onto closed/sealed-end of a flexible tube while in an alternative embodiment the tool structure is fixed onto the closed/sealed end. In another embodiment the soft-applicator is supported at the open end of the tube using barbs as described with reference to FIGS. 51 to 53. In one combination embodiment the tool body structure is detachably attached onto closed/sealed end of the flexible tube while the soft-applicator is attached to the open-end using barbs. In another combination embodiment the tool body structure is fixed onto closed/sealed end of the flexible tube while the soft-applicator is attached to the open-end using barbs.

It should be appreciated that the present invention can combine the aforementioned features into different final product embodiments. For example, the tube size and style could be a round or oval tube with any one of a 19 mm, 22 mm, 25 mm, 28 mm, 30 mm, 35 mm, 38 mm, 40 mm, 45 mm, 50 mm, or 60 mm diameter. The head style can be any one of a blade, spreader, shaving razor, scraping razor, paint brush, wire scrubbing brush, plastic bristle scrubbing brush, foot file, foot grater, sanding block, surface scrubber, staining cloth, or rub-in applications. Exemplary embodiments are further disclosed below, with any of the embodiments capable of having a) a tube construction made of mono layer polyethylene, multi-layer polyethylene with EVOH, low density polyethylene, or high density polyethylene, b) a mono layer or multi layer tube type, c) an extruded tube length or predefined tube length in the range of 20 mm to 300 mm, or d) a tube with a valve system that is actuated by a bar-bell spring action, a center piston with radial discs attached to each end of the piston (which is pressure fit into the interior orifice with a plastic or silicone spring), or a center orifice sealed with a radial washer or in equal or slightly larger radius of the piston.

| Head Style | Tube Size & Style | Method of Attachment to Tube | Applicator Installation | Tool Attachment |
|---|---|---|---|---|
| Blade | Round tube | Clip on | Pressure fit | Single piece injection mold |
| Spreader | 19 mm dia | Slide on | Glue-in place | "Click in" |
| Shaving Razor | 22 mm dia | Snap on | Pressure fit with barbs | Conforming components molded to permanently join with overcut/undercut construction to allow secure fit. |
| Scraping Razor | 25 mm dia | Permanently weld | Barb specs 2 mm to 4 mm length | Threaded screw on - a threaded cap and a threaded neck where the cap is affixed to the neck by direct axial application so that the mating threads slip past one another and into engagement. The cap further includes a seal to capture and constrict the outer diameter of the neck, and valve to plug the container opening in the neck and expand the outer diameter of the neck, so that the seal and valve cooperate to improve sealing the cap and neck. The cap and neck further include a tamper-indicator to prevent removal of the cap without activation thereof. |
| Paint Brush | 28 mm dia | Hinged | Barb specs 1 to 3 mm dia | |
| Wire Scrubbing Brush | 30 mm dia | Alignment guides | Conical in shape | Screw click - safety lock with pressure release |
| Plastic Bristle Scrubbing Brush | 35 mm dia | "Bite" into seal | Cylindrical in shape | Pressure fit |
| Foot file | 38 mm dia | | Single row | |
| Foot grater | 40 mm dia | | Multiple rows | |
| Sanding block | 45 mm dia | | Positioned perpendicular to exterior socket wall | Snap fit |
| Surface scrubber | 50 mm dia | | Slighlty angled upward or downward not to exceed 30 degrees obove or below horizontal plane | Screw cap for threaded opening type containers |
| Staining cloth | 60 mm dia | | | |
| Rub-in applications | Oval Tube | | | Attachments disclosed in U.S. Pat. No. 6,253,942, which is herein incorporated by reference |

The invention has been described with specific embodiments but the spirit and intent of the invention is not limited to such specific embodiments. The specific embodiments have been used to illustrate some examples of the present invention but are intended to be limitations of the scope of the present invention.

The invention claimed is:

1. A kit comprising:

a tube having a length, a front side, a back side opposing said front side, a first end with an opening and a second end that is sealed, wherein the front side and back side are defined by said length;

a tube tool structure, wherein said tube tool structure is removably attachable to a portion of the tube, comprising a tool device;

a frame wherein said frame comprises a first side having a pair of vertically extending shoulders that, in combination, form a U-shaped structure and, with said front side, form a first plane, wherein the first side is further defined by a connecting region in said first plane extending between said shoulders, wherein a portion of said connecting region is depressed relative to each of said shoulders, and a second side that has an arcuate shape and opposes said first side, wherein the first side and second side define a space capable of removably receiving at least one end of the tube; and a platform that is physically attached to said tool device and said frame, wherein a combination of said frame, platform and tube provides a handle for using said tool device.

2. The kit of claim 1 wherein a hole is positioned in said depressed portion of the connecting region and extends from the first side to the second side.

3. The kit of claim 2 wherein the vertically extending shoulders are adapted to extend along the length of said tube.

4. The kit of claim 2 wherein the tool device is attached to said platform by screwing the tool device into said platform or snapping the tool device into said platform.

5. The kit of claim 1, wherein the tool device is one of a razor, brush, scraper, blade, massager head, brush, sponge, support plate for sandpaper, or polishing device.

6. The kit of claim 1, wherein the frame has a pair of ribs that form left and right sides of the frame and join at the top to form a neck culminating into said platform for supporting the tool device, wherein the ribs define a substantially triangular portion therebetween for receiving an end of a tube and wherein said frame further comprises a downwardly extending helical arm.

7. The kit of claim 1, wherein the frame has a pair of ribs that form left and right sides of the frame and join at the top to form a neck culminating into the platform for supporting the tool device, wherein the ribs define a substantially triangular portion therebetween for receiving an end of the tube and wherein outer ends of said ribs extend downwards to form two vertical sides which join at the bottom to form a front horizontal rib and a back horizontal rib.

8. The kit of claim 1, wherein the frame has a pair of ribs that form left and right sides of the frame and join at the top to form a neck culminating into the platform for supporting the tool device, wherein the ribs define a substantially triangular portion therebetween for receiving an end of the tube and wherein outer ends of the ribs extend downwards to form two vertical sides.

9. The kit of claim 1, wherein the frame has a pair of ribs that form left and right sides of the frame and join at the top to form a neck culminating into the platform for supporting the tool device, wherein the ribs define a substantially triangular portion therebetween for receiving an end of the tube and wherein a single elongated member extends downward from at least one of said ribs, said elongated member terminating in a curved member that defines a space for receiving a portion of said tube.

10. The kit of claim 1, wherein the frame has a pair of ribs that form left and right sides of the frame and join at the top to form a neck culminating in the platform for supporting the tool device, wherein the ribs define a substantially triangular portion therebetween for receiving an end of the tube.

* * * * *